US005412462A

United States Patent [19]

Matsuo et al.

[11] Patent Number: 5,412,462

[45] Date of Patent: May 2, 1995

[54] AUTOMATIC DOCUMENT CONVEYING APPARATUS

[75] Inventors: Takeshi Matsuo; Yoshiyuki Takeda; Takeshi Yoshida; Masayuki Kakuta; Yasuhiko Kida; Hiroyuki Harada, all of Osaka, Japan

[73] Assignee: Mita Industrial Co., Ltd., Osaka, Japan

[21] Appl. No.: 76,867

[22] Filed: Jun. 15, 1993

[30] Foreign Application Priority Data

Jun. 16, 1992 [JP] Japan ..... 4-156379

[51] Int. Cl.[6] ..... G03G 15/00

[52] U.S. Cl. ..... 355/308; 271/4; 355/313

[58] Field of Search ..... 355/308, 309, 311, 313, 355/314, 317, 203, 204, 209, 208; 271/3.1, 8, 9, 10, 4, 3, 18; 226/1, 27, 28

[56] References Cited

U.S. PATENT DOCUMENTS

| | | | |
|---|---|---|---|
| 4,227,803 | 10/1980 | Massengeil et al. | 355/50 |
| 4,452,525 | 6/1984 | Ogura | 355/308 X |
| 4,638,987 | 1/1987 | Sakurai | 271/111 |
| 4,693,461 | 9/1987 | Takahashi | 271/176 |
| 4,903,085 | 2/1990 | Ikeda et al. | 355/320 |
| 5,010,371 | 4/1991 | Matsuo et al. | 355/313 |
| 5,033,728 | 7/1991 | Miura et al. | 271/3 |
| 5,140,365 | 8/1992 | Hashimoto | 355/50 |
| 5,207,412 | 5/1993 | Coons, Jr. et al. | 270/1.1 |
| 5,222,723 | 6/1993 | Ijuin | 271/10 |
| 5,279,453 | 1/1994 | Hashimoto | 226/27 |
| 5,295,616 | 3/1994 | Saeki et al. | 226/110 |

FOREIGN PATENT DOCUMENTS

| | | |
|---|---|---|
| 0333140 | 9/1989 | European Pat. Off. . |
| 3602488 | 7/1986 | Germany . |
| 01321249 | 3/1990 | Japan . |
| 0295663 | 6/1990 | Japan . |

*Primary Examiner*—A. T. Grimley
*Assistant Examiner*—Thu A. Dang
*Attorney, Agent, or Firm*—Antonelli, Terry, Stout & Kraus

[57] ABSTRACT

An automatic document conveying apparatus in which a normal continuous document conveying state and a single document conveying state, suitable for a document having high importance such as an original of a design, can be selectively determined, and carrying and discharging of documents can be fully well conducted. In a document carrying passage, a restricting member and a separation roller which cooperate with a feed roller are disposed. The forward end of the restricting member approaches or contacts the feed roller, and the separation roller is driven to rotate in a direction opposite to the document conveying direction in the continuous document conveying state. In the single document conveying state, the restricting member is isolated from the feed roller, and the separation roller can be freely rotated.

33 Claims, 14 Drawing Sheets

AUTOMATIC DOCUMENT CONVEYING APPARATUS

FIELD OF THE INVENTION

This invention relates to an automatic document conveying apparatus to be applied to an image processing apparatus such as an electrostatic copying machine or an image reader.

DESCRIPTION OF THE PRIOR ART

In an automatic document conveying apparatus such as on an electrostatic copying machine or an image reader, a transparent plate which may be a glass sheet is disposed on the upper surface of a housing, and a document to be copied or a document to be read is required to be positioned onto a predetermined site of the transparent plate. For automation of a document processing operation, automatic document conveying apparatuses of various forms have been proposed and put into practice in recent years to carry a document to be copied or a document to be read onto a predetermined site of the transparent plate and to deliver the document off of the transparent plate. The prior art disclosing typical examples of the automatic document conveying apparatuses includes, for example, Japanese Laid-Open Patent Publications Nos. 229,744/1986 and 295,334/1988.

In a typical example of the automatic document conveying apparatus, a frame is so mounted on the housing of the image processing machine that the frame can be pivoted between a closed position and an open position on, as a center, a frame pivoting axial line extending along one edge of the transparent plate. The frame is nearly box-shaped usually, with its under surface being open. When it is in the closed position, the frame covers the transparent plate and when it is in the open position, it exposes the transparent plate. For placing a document on the transparent plate manually, the frame must be also opened or closed with hand. A document placing means and a document receiving means are disposed on the frame. Furthermore, within the frame, there are defined a document carrying passage extending from the document placing means to the transparent plate and a document delivery passage extending from the transparent plate to the document receiving means. When the frame is positioned at the closed position, its under surface defines a document transfer passage which extends along the transparent plate, and a document conveying passage is formed which follows the document delivery passage from the document carrying passage via the document transfer passage. Furthermore, within the frame, a document conveying means is disposed for conveying a document through the document carrying passage, the document transfer passage and the document delivery passage. This document conveying means includes a document carrying means for conveying a document through a document carrying passage, the document transfer means for conveying a document through the document transfer passage, and a document delivery means for conveying a document through the document delivery passage.

The document carrying means includes a document sending means for sending a document placed on the document placing means to the document carrying passage and a document overlappingly sending preventing means disposed on the downstream side of the document sending means for preventing two or more documents simultaneously from being conveyed through the document carrying passage. The document sending means is composed of a carrying roller formed from a material such as a relatively soft synthetic rubber and a pressing member formed of a material such as a relatively rigid metal plate or a synthetic resin. The carrying roller is driven to rotate in the document carrying direction. The pressing member, disposed in opposition to the carrying roller, is biased toward the peripheral surface of the carrying roller by a suitable means such as an electromagnetic solenoid. The document placed on the document placing means is held between the carrying roller and the pressing member. The document overlappingly sending preventing means includes a feed roller and a separation roller disposed in opposition to each other. The feed roller is driven to rotate in the document conveying direction. On the other hand, the separation roller is connected to a rotation driving source via a torque limiter limiting a transmission torque in a direction opposite to the document conveying direction to a predetermined value, and is rotatably driven in a direction opposite to the document conveying direction within a predetermined transmission torque. The document overlappingly sending preventing means further has a restriction member which approaches or contacts the feed roller on the upper stream side of the separation roller. By the restriction action of the restriction member, documents to be sent between the feed roller and the separation roller are limited to less than a few, and only one document is allowed to advance due to the co-operative action of the feed roller and the separation roller.

A plurality of document detectors are provided in the document carrying passage, and a document detector is provided also in the document delivery passage. The document detectors disposed in the document carrying passage detect the advance of the documents sent through the document carrying passage and also detect the size of the carried documents. With a view to stacking the documents discharged to the document receiving means sequentially and properly, the document conveying speed of the document delivery means is decreased to a discharge speed smaller than a usual document conveying speed when the document detector in the document delivery passage detects the rear edge of the document.

The conventional automatic document conveying apparatus has, however, the following problems to be solved.

Firstly, it is not rare that a document such as an original of a design written on tracing paper is conveyed by the automatic document conveying apparatus. Such a document as an original of a design has higher importance in processing than ordinary copied products, and it is required to reliably prevent it from suffering breakage or injury. However, because of the special nature and/or the relatively larger size of the material of such document and further because a document is curved in many cases, it is difficult to separate the documents reliably by the document overlappingly sending preventing means, and it is relatively frequently found that the documents are clogged in the document conveying passage. Therefore, in the conventional automatic document conveying apparatus, particularly when copying is performed of an original of a design the importance of which requires reliably preventing it from suffering breakage or injury, there often is imperfect separation in the document overlappingly sending preventing means and/or clogging in the document conveying passage. This will often result in breakage or injury of the document.

Secondly, the action of the carrying roller for sending the document placed on the document placing means to the document carrying passage depends greatly upon the pressing force of the document to be carried toward the peripheral surface of the carrying roller which is formed of a material such as a relatively soft synthetic rubber. In the conventional automatic document conveying apparatus, the pressing force drastically varies with the number of documents placed on the document placing means and whether their front portions are held between the carrying roller and the pressing member which is disposed in opposition thereto, and therefore the document carrying action by the carrying roller is unstable.

Thirdly, in the conventional automatic document conveying apparatus, when the front portion of the document is curved upwardly, the document in the document overlappingly sending preventing means contacts only the separation roller and tends to be clogged without contacting the peripheral surface of the feed roller. Furthermore, when the document has relatively low stiffness and is large in size, the document is often curved, for example with a wavy form, in the width direction on both side portions of the document sending roller, or creased in the conventional document conveying apparatus.

Fourthly, when the document is relatively large in size, the resistance to the discharge of the document is relatively large in the state where the front half portion of the document is discharged onto the document receiving means, in comparison with a document having relatively small size. Due to this fact, in the conventional automatic document conveying apparatus, when the document is relatively large, the document is not completely discharged onto the document receiving means, and the rear end of the document remains contacting the document discharge roller, thereby tending to cause incomplete discharge.

Fifthly, when no document exists on the document receiving means, namely, as the first document is being discharged onto the document receiving means, the discharged document is moved onto the surface of the document receiving means itself and therefore, experiences a relatively large resistance to moving. On the other hand, when a previously discharged document is on the document receiving means, newly discharged document is moved onto the surface of the first document and therefore, experiences a relatively small resistance to moving. In view of this fact, in the conventional automatic document conveying apparatus, the first document and the second or subsequent document considerably differ in discharge condition, and the discharged documents cannot be stacked very well.

SUMMARY OF THE INVENTION

The first object of the present invention is to provide an improved automatic document conveying apparatus wherein when the document is, for example, an original of a design for which there is high importance in preventing the document from suffering breakage or injury, such document is conveyed in a manner different from that of the ordinary documents, so that the important document can fully reliably avoid breakage or injury.

The second object of the present invention is to make the pressing force of any document to be carried to the peripheral surface of the carrying roller nearly the same regardless of the number of documents placed on the document placing means, thereby fully stabilizing the document carrying action of the carrying roller.

The third object of the present invention is to provide an improved automatic document conveying apparatus which can convey documents fully well without causing clogging even when the front portion of the documents is curved upwardly or the document has relatively low stiffness and is large in size, and without curving the document in a wavy form in a widthwise direction or forming creases in the document.

The fourth object of the present invention is to provide an improvement such that even when the document is relatively small or relatively large, the document can be discharged satisfactorily onto the document receiving means.

The fifth object of the present invention is to provide an improved automatic document conveying apparatus wherein the first document and the second or subsequent document can be discharged nearly in the same way onto the document receiving means and therefore, can be stacked very well.

In a first aspect of the present invention, the first object is achieved by disposing a state changing means which can selectively determine a continuous document conveying state and a single document conveying state. When it is important to avoid breakage or injury of a document, the single document conveying state is preselected. In this single document conveying state, (1) the separation roller in the document overlappingly sending preventing means is freely rotated in the document conveying direction; (2) the restricting means in the document overlappingly sending preventing means is placed in a non-acting position to be separated from the feed roller; or (3) the speed of conveying the document at least through the document carrying passage and the document delivery passage is lowered from a usual conveying speed.

According to the first aspect of the present invention, there is provided an automatic document conveying apparatus comprising a document placing means, a document carrying passage extending from the document placing means, a document sending means for sending a document placed on the document placing means to the document carrying passage, and a document overlappingly sending preventing means disposed downstream of the document sending means for preventing two or more documents from being conveyed simultaneously through the document carrying passage, the document overlappingly sending preventing means, including a feed roller and a separation roller, disposed in opposition to each other, between which a document is sent by the action of the document sending means, the feed roller being driven to rotate in the document conveying direction, and the separation roller being driven to rotate in a direction opposite to the document conveying direction; wherein the separation roller is detachably connected to a rotation driving source, a state changing means is disposed in relation to the separation roller, and the state changing means selectively determines a continuous document conveying state in which the separation roller is connected to the rotation driving source and driven to rotate in a direction opposite to the document conveying direction and a single document conveying state in which the separation roller it is liberated from the rotation driving source and is allowed to be freely rotated in the document conveying direction.

Furthermore, according to the first aspect of the present invention, there is provided an automatic document conveying apparatus comprising a document placing means, a document carrying passage extending from the document placing means, a document sending means for sending a document placed on the document placing means to the document carrying passage, a document overlappingly sending preventing means disposed downstream of the document sending means for preventing two or more documents from being conveyed simultaneously through the document carrying passage, the document overlappingly sending preventing means including a feed roller driven to rotate in the document conveying direction and a restriction member disposed in relation to the feed roller; wherein the restriction member is mounted movably between an acting position at which it approaches or contacts the feed roller and a non-acting position at which it is isolated from the feed roller, a state changing means is disposed in relation to the restriction member, and the state changing means selectively determines a continuous document conveying state in which the restriction member is positioned at the acting position and a single document conveying state in which the restriction member is positioned at the non-acting position.

Furthermore, according to the first aspect of the invention, there is also provided an automatic document conveying apparatus comprising a document placing means, a document receiving means, a document conveying passage including a document carrying passage extending from the document placing means, a document transfer passage following a document carrying passage and extending along the transparent plate of an image processing machine, and a document delivery passage extending from the document transfer passage to the document receiving means, a document conveying means including a document carrying means for conveying a document through the document carrying passage, a document transfer means for transferring a document through the document transfer passage, and a document delivering means for discharging a document through a document discharging passage, and an operation control means; wherein a state changing means is disposed which selectively determines a continuous document conveying state and a single document conveying state, when the continuous document conveying state is determined, the control means conveys a document through at least the document carrying passage and the document transfer passage at a usual conveying speed of V1, and when the state changing means determines the single document conveying state, the control means allows a document to be conveyed at a conveying speed V2, smaller than the usual conveying speed V1, through at least the document carrying passage and the document transfer passage.

In a second aspect of the present invention, to achieve the second object, collar members, which are of a relatively rigid material, are mounted concentrically and rotatably on both sides of the carrying roller, which is formed of a relatively soft material, the outer diameter of the collar members are made substantially the same as or a little bit smaller than the outer diameter of the carrying roller, and both end portions of the pressing member are positioned in opposition to the collar members.

That is, according to the second aspect of the present invention, there is provided an automatic document conveying apparatus comprising a document placing means, a document carrying passage extending from the document placing means, a document sending means for sending a document placed on the document placing means to the document carrying passage, the document sending means including a carrying roller formed of a relatively soft material and driven to rotate in the document carrying direction, a pressing member formed of a relatively rigid material and disposed in opposition to the carrying roller, and a biasing means for biasing the pressing member toward the peripheral surface of the carrying roller, and the front end portion of the document placed on the document placing means being interposed between the carrying roller and the pressing member; wherein collar members formed of a relatively rigid material are concentrically and rotatably mounted on both sides of the carrying roller, the outer diameter of the collar members is substantially the same as, or somewhat smaller than, the outer diameter of the carrying roller, and both end portions of the pressing member are positioned in opposition to the collar members.

In a third aspect of the present invention, to achieve the third object, a synthetic resin film guide member is disposed on both sides of the carrying roller and the pressing member which constitute the document sending means and on both sides of the feed roller and the separation roller which constitute the document overlappingly sending preventing means which guide member extends from an upstream side of the carrying roller toward the feed roller and the separation roller and from above the carrying roller to below the nip position between the feed roller and the separation roller.

According to a third aspect of the present invention, there is provided an automatic document conveying apparatus comprising a document placing means, a document carrying passage extending from the document placing means, a document sending means for sending a document placed on the document placing means to the document carrying passage, a document overlappingly sending preventing means disposed downstream of the document sending means for preventing two or more document from being conveyed simultaneously through the document carrying passage, the document sending means including a carrying roller formed of a relatively soft material and driven to rotate in the document carrying direction, a pressing member formed of a relatively rigid material and disposed opposite to the carrying roller, and a biasing means biasing toward the peripheral surface of the carrying roller, the front portion of the document placed on the document placing means being interposed between the carrying roller and the pressing member, the document overlappingly sending preventing means including a lower side feed roller and an upper side separation roller, being disposed opposite to each other, between which a document is sent by the action of the document sending means, the feed roller being driven to rotate in the document conveying direction, and the separation roller being driven to rotate in a direction opposite to the document conveying direction; wherein on both sides of the carrying roller, the pressing member, the feed roller and the separation roller, a guide member of a synthetic resin film is disposed which extends from an upstream side of the carrying roller toward the feed roller and the separation roller and from above the carrying roller to below the nip site of the feed roller and the separation roller.

In a fourth aspect of the present invention, to achieve the fourth object, when a document to be delivered is larger than a predetermined size, the document delivering speed is decreased to the discharge speed and the operation time of the document delivering means is somewhat made longer.

According to the fourth aspect of the present invention, there is provided an automatic document conveying apparatus comprising a document placing means, a document receiving means, a document conveying passage include a document carrying passage extending from the document placing means, a document transfer passage following the document carrying passage and extending along a transparent plate of an image processing machine, and a document delivering passage extending from the document transfer passage to the document receiving means, a document conveying means including a document carrying means for conveying a document through the document carrying passage, a document transfer means for transferring a document through the document transfer passage, and a document delivering means for discharging a document through a document delivery passage, a carried document detecting means for detecting a document carried through the document carrying passage, a delivered document detecting means for detecting a document delivered through a document delivery passage, an operation control means, and when the delivered document detecting means detects the rear end of the document, the control means decreases the document delivering speed by the document delivering means to a discharge speed V3 smaller than a usual conveying speed V1 and after the lapse of a predetermined period time T, the control means stops the operation of the document delivering means; wherein when the document to be detected by the carried document detecting means is larger than a predetermined size, the predetermined time is T-L, when the document to be detected by the carried document detecting means is smaller than the predetermined size, the predetermined time is T-S, and the predetermined time T-L is longer than the predetermined time T-S.

To achieve the fifth object, in a fifth aspect of the present invention, the discharge speed of the first document to be delivered is made somewhat larger than the discharge speed of the subsequent document.

According to the fifth aspect of the present invention, there is provided an automatic document conveying apparatus comprising a document placing means, a document receiving means, a document conveying passage including a document carrying passage extending from the document placing means, a document transfer passage following the document carrying passage and extending along a transparent plate of an image processing machine, and a document delivery passage extending from the document transfer passage to the document receiving means, a document conveying means including a document carrying means for conveying a document through the document carrying passage, a document transfer means for transferring a document through the document transfer passage, and a document delivering means for discharging a document through the document discharge passage, a carried document detecting means for detecting a document carried through the document carrying passage, a delivered document detecting means for delivering a document through the document delivery passage, and an operation control means, and when the delivered document detecting means detects the rear end of the document by the control means, the document delivering speed by the document delivering means decreases to a discharge speed V3 smaller than an ordinary conveying speed V1 and after the lapse of a predetermined period of time T, the control means stops the operation of the document delivering means; wherein when from the beginning of the operation, the document to be detected by the delivered document detecting means is the first document, the discharge speed is V3-1, and when from the beginning of the operation, the document to be detected by the delivered document detecting means is the second or subsequent document, the discharge speed is V3-2, and the discharge speed V3-1 is larger than the discharge speed V3-2.

In the automatic document conveying apparatus constructed in accordance with the first aspect of the present invention, when a single document conveying state is predetermined, the separation roller or the restriction member in the document overlappingly sending preventing means is unable to operate, and its separating action is avoided, or the document conveying speed is decreased, whereby the possibility of breaking or damaging an original of a design which is highly important can be avoided reliably.

In the automatic document conveying apparatus constructed in accordance with the second aspect of the present invention, a pressing force exerted on the document by the pressing member is basically received by the collar member, and the pressing force between the carrying roller and the document contacting its peripheral surface is specified only by a predetermined partial pressure ascribable to the elastic deformation of the carrying roller. Accordingly, the pressing force is maintained nearly the same irrespective of the number of the documents, and thus, the document carrying action by the carrying roller is sufficiently stabilized.

In the automatic document conveying apparatus constructed in accordance with the third aspect of the present invention, the forward end portion of the document is introduced on the side of the feed roller further from the nip portion of the feed roller and the separation roller by the guiding action of a guide member formed of a synthetic resin film and is contacted surely on the peripheral surface of the feed roller. Furthermore, the presence of the guide member sufficiently inhibits the deformation or crease formation of the document on both side portion of the carrying roller and the pressing member, and thus, even when the front portion of the document is curved upwardly or when the document has a relatively low stiffness and is large in size, the document can be conveyed very well.

In the automatic document conveying apparatus constructed in accordance with the fourth aspect of the present invention, when the document is relatively large in size and receives a relatively large discharge resistance, the discharge operation of the document delivering means is relatively lengthened, and thus the document can be discharged relatively well on the document receiving means, whether the document is relatively small or relatively large.

In the automatic document conveying apparatus constructed in accordance with the fifth aspect of the present invention, the first document, which experiences a relatively larger moving resistance than the second or subsequent documents, is discharged at a higher discharge speed than the second or subsequent documents. Accordingly, the first document is discharged to the document receiving means in nearly the same way as the second or subsequent documents and the discharged documents are fully well stacked.

DETAILED DESCRIPTION OF PREFERRED EMBODIMENTS

Hereinafter, the invention will be described in detail with reference to the accompanying drawings showing preferred embodiments of the automatic document conveying apparatus constructed in accordance with the present invention.

Figure 1:
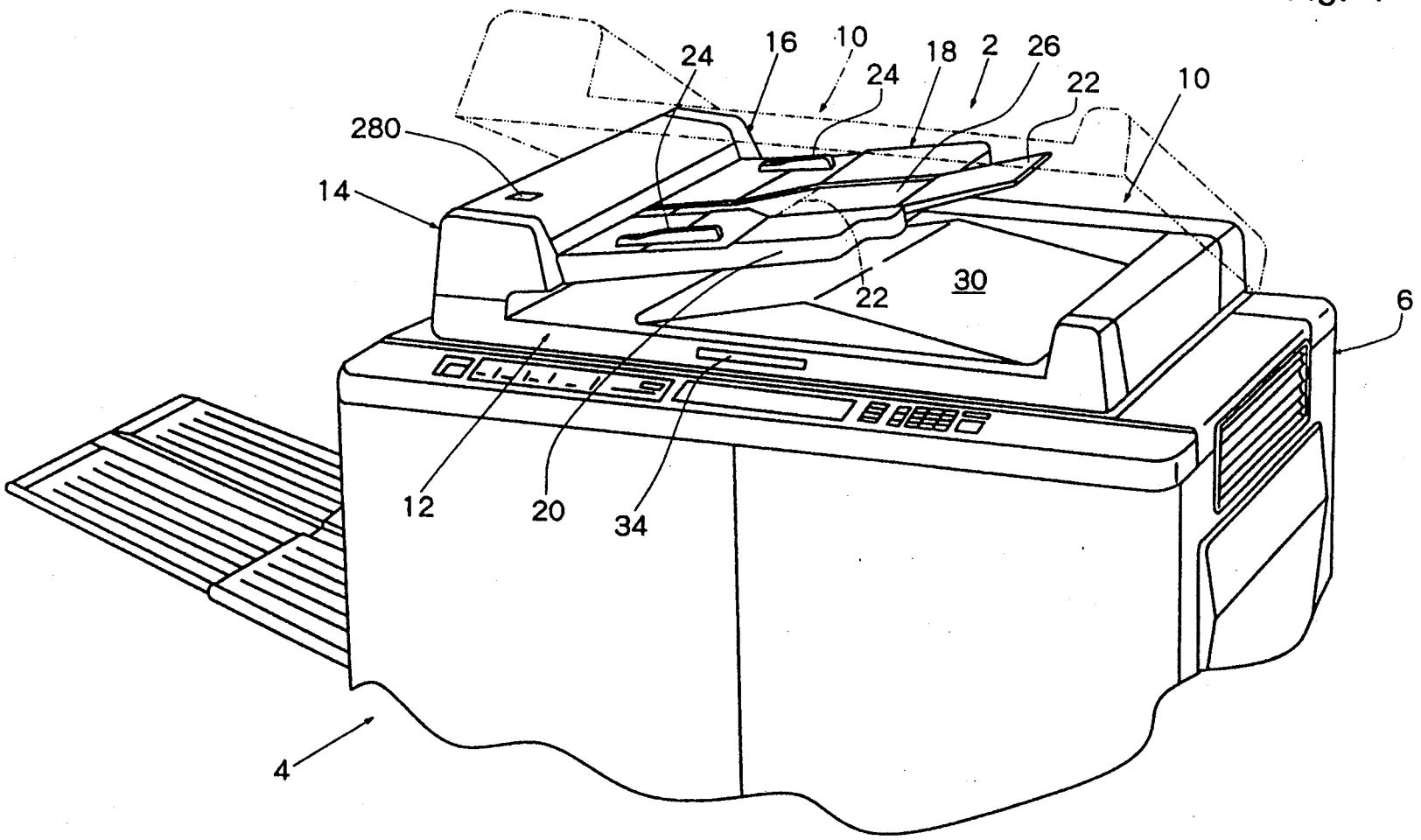
FIG. 1 is a perspective view showing a preferred example of an automatic document conveying apparatus constructed in accordance with this invention provided in an electrostatic copying machine.
Figure 2:
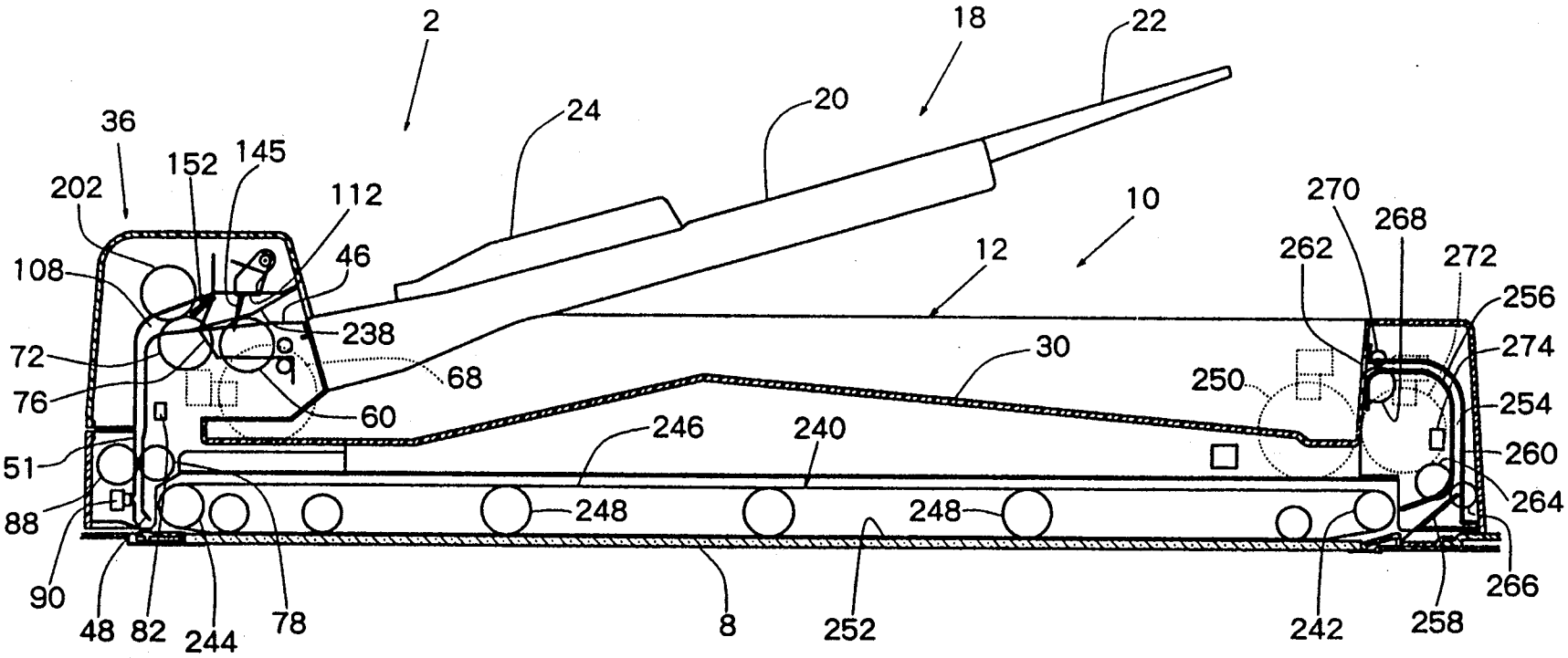
FIG. 2 is a sectional view showing the automatic conveying apparatus of FIG. 1.

With reference to FIGS. 1 and 2, in the illustrated embodiments, an automatic document conveying apparatus shown generally by 2 is applied to an electrostatic copying machine 4. The electrostatic copying machine 4 has a nearly parallelepiped housing 6, and on the upper surface of the housing 6, a transparent plate 8 (FIG. 2), which may be made of glass, is provided. A document to be copied is required to be positioned on a required site of the transparent plate 8. The electrostatic copying machine 4 may be of a known form, and therefore, the construction of the electrostatic copying machine 4 will be omitted.

The automatic document conveying apparatus 2 constructed in accordance with the present invention includes a main frame 10. The main frame 10 is mounted on the housing 6 of the electrostatic copying machine 4 in such a manner that it is free to pivot between a closed position, shown by a solid line in FIG. 1, and an open position shown, by a two-dotted chain line in FIG. 1, on, as a center, a main frame pivoting axial line extending along the rear edge of the transparent plate 8. The main frame 10 includes a frame member 12 which is nearly box-shaped. The under surface of the frame member 12, which may be molded from a suitable synthetic resin, is open as can be understood from FIG. 2. One end portion (the left end portion in FIG. 2) of the main frame 10 is bulged upwardly (in this end portion, a document carrying passage is formed as described later). Similarly, the other end portion (the right end portion in FIG. 2) of the main frame 10 is bulged upwardly (in this other end portion, a document discharge passage is formed as described later). As is clearly shown in FIG. 1, in the first upper end portion of the main frame 10, an upstanding front wall portion 14 and an upstanding rear wall portion 16 are formed, spaced from each other in a widthwise direction (in a direction perpendicular to the sheet surface in FIG. 2) on the frame member 12. Between the front wall portion 14 and the rear wall portion 16, a document placing means 18, extending in the right direction in FIG. 2, is disposed. This document placing means 18 includes a placing member 20 and an auxiliary placing member 22. The placing member 20 is nearly rectangular, and extends in the right direction in FIG. 2 from a forward end portion mounted between the front wall portion 14 and the rear wall portion 16. A pair of width regulating members 24, which are freely movable in a direction approaching each other or in an isolated direction from each other, are disposed on the upper surface of the placing member 20. A concave portion 26 is formed at the center in a widthwise direction of the placing member 20, and the width of the latter half portion of this concave portion 26 nearly corresponds to the width of the auxiliary placing member 22. The auxiliary placing member 22 is mounted pivotably between an acting position, shown by a solid line, and a non-acting position, shown by a two-dotted chain line, at the center in a widthwise direction of the rear end of the placing member 20. When a document to be copied, i.e., a document placed on the document placing means 18 is relatively large, the auxiliary placing member 22 is positioned at the acting position extending further rearwardly from the rear end of the placing member 20, and the rear end portion of the document is supported on the auxiliary placing member 22. When a document to be copied, i.e., a document placed on the document placing member 18 is relatively small, the auxiliary placing means 22 is positioned at the non-acting position at which the auxiliary placing means 22 is accommodated in the concave portion 26 of the placing member 20. The upper surface of the central main portion of the frame member 12, which is positioned below the document placing means 18, constitutes a document receiving means 30 for receiving a document discharged from the bulged other end portion of the main frame 10. The upper surface of the central main portion of the frame member 12 constituting the document receiving means 30 is raised centrally in the longitudinal direction, namely inclinedly extends upwardly from the left portion toward the central portion in FIG. 2, and then inclinedly extends downwardly from the central portion toward the right portion in FIG. 2. A grip concave portion 34 is formed in the front surface of the central main portion of the frame member 12. When main frame 10 is opened or closed pivotably between the closed position shown by a solid line in FIG. 1 and the open position shown by a two-dotted chain line shown in FIG. 1, one hand may be put on the grip concave portion 34.

Figure 3:
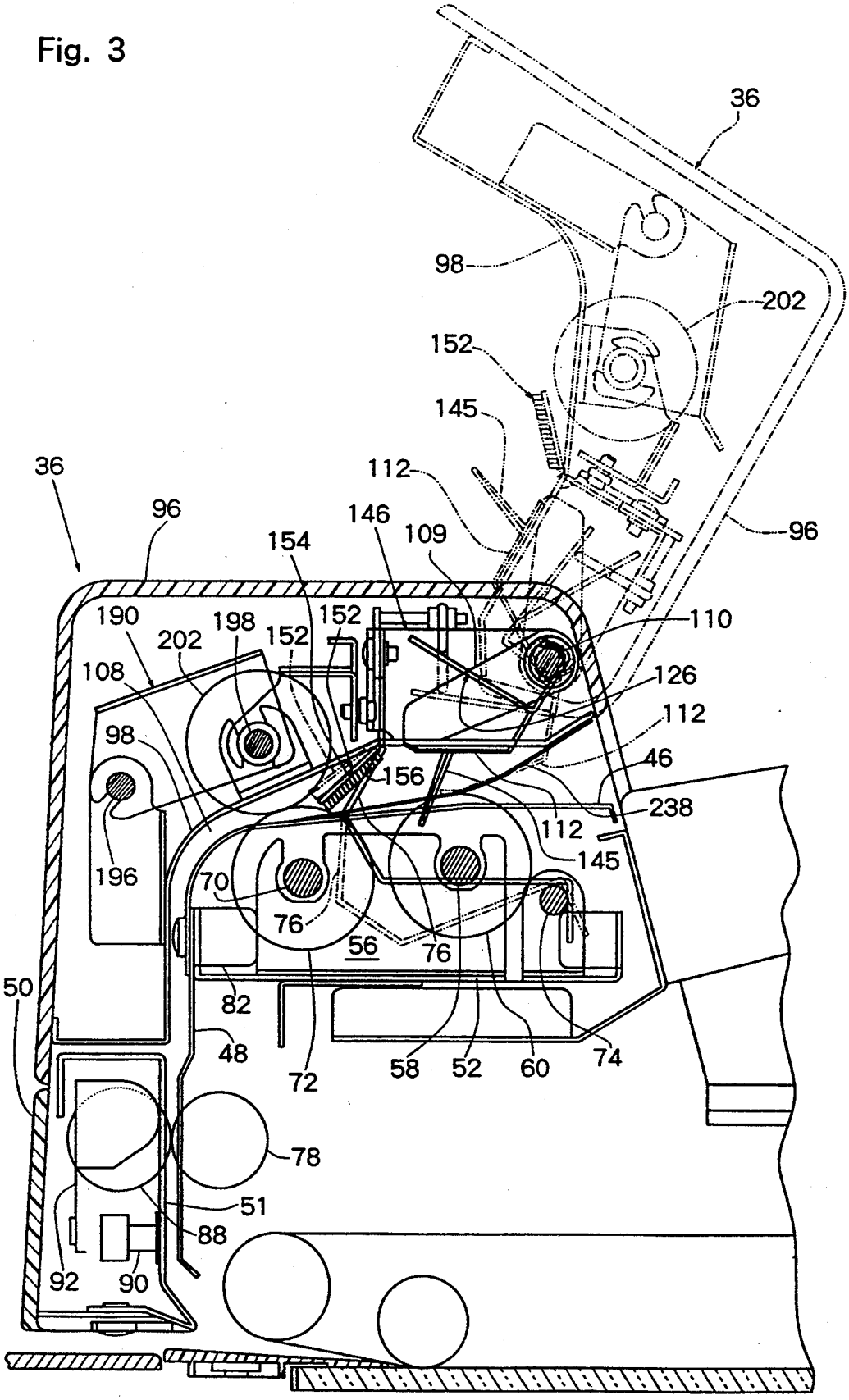
FIG. 3 is a partial sectional view showing a document carrying passage portion of the automatic document conveying apparatus of FIG. 1.

With reference to FIGS. 1 and 2 together with FIG. 3, an opening and closing frame 36 is disposed between the upstanding front wall portion 14 and the upstanding rear wall portion 16 of the frame member 12. The opening and closing frame 36 is mounted pivotably on an opening and closing pivoting axial line, as a center, extending perpendicularly to the sheet surface in FIGS. 2 and 3 between a closed position shown by a solid line in FIGS. 1, 2 and 3 and an open position shown by a two-dotted chain line in FIG. 3 (the mounting of the opening and closing frame 36 will be described in detail later).

Figure 4:
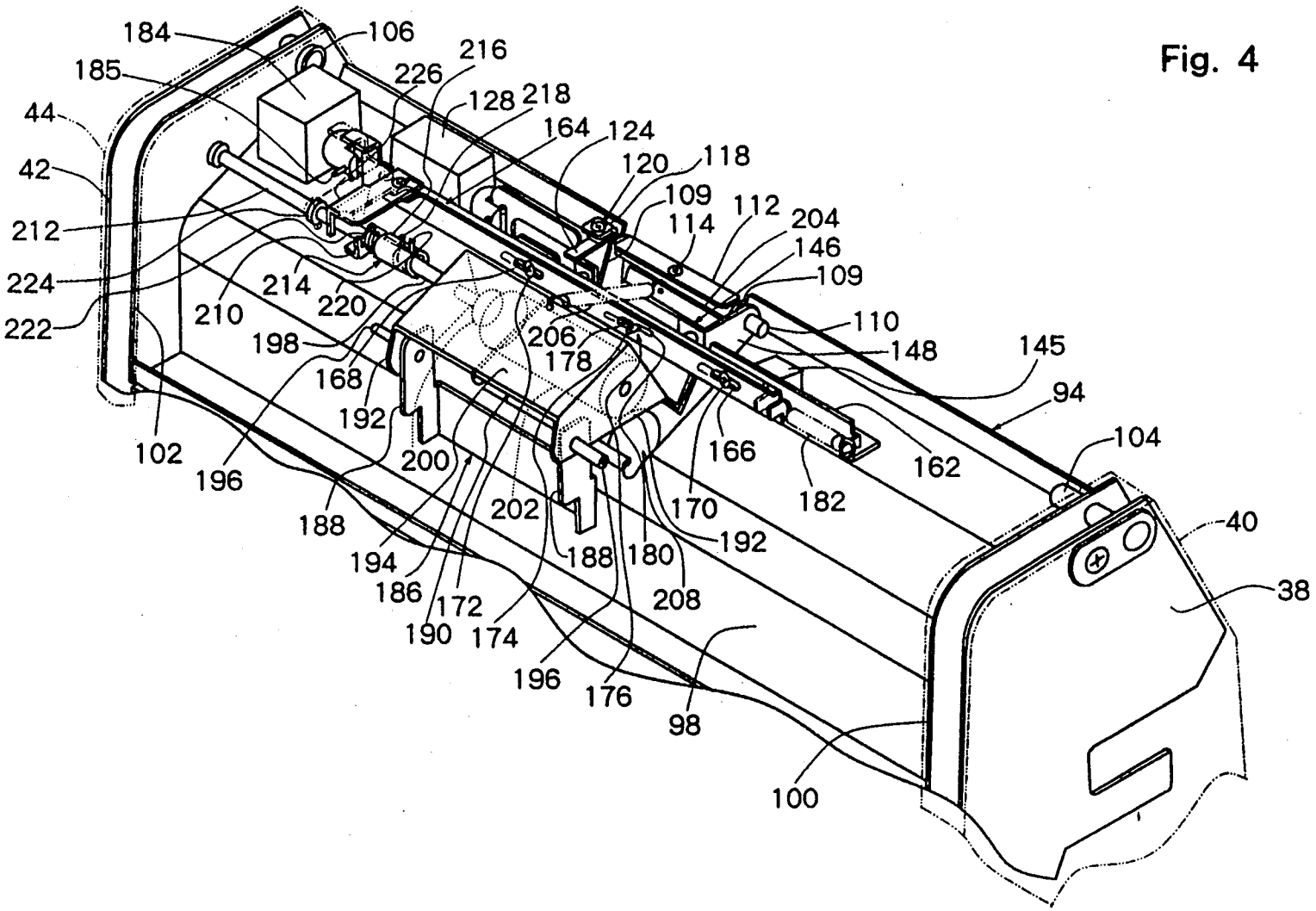
FIG. 4 is a partial perspective view showing, in a cutaway manner, the document carrying passage portion of the automatic document conveying apparatus of FIG. 1.
Figure 5:
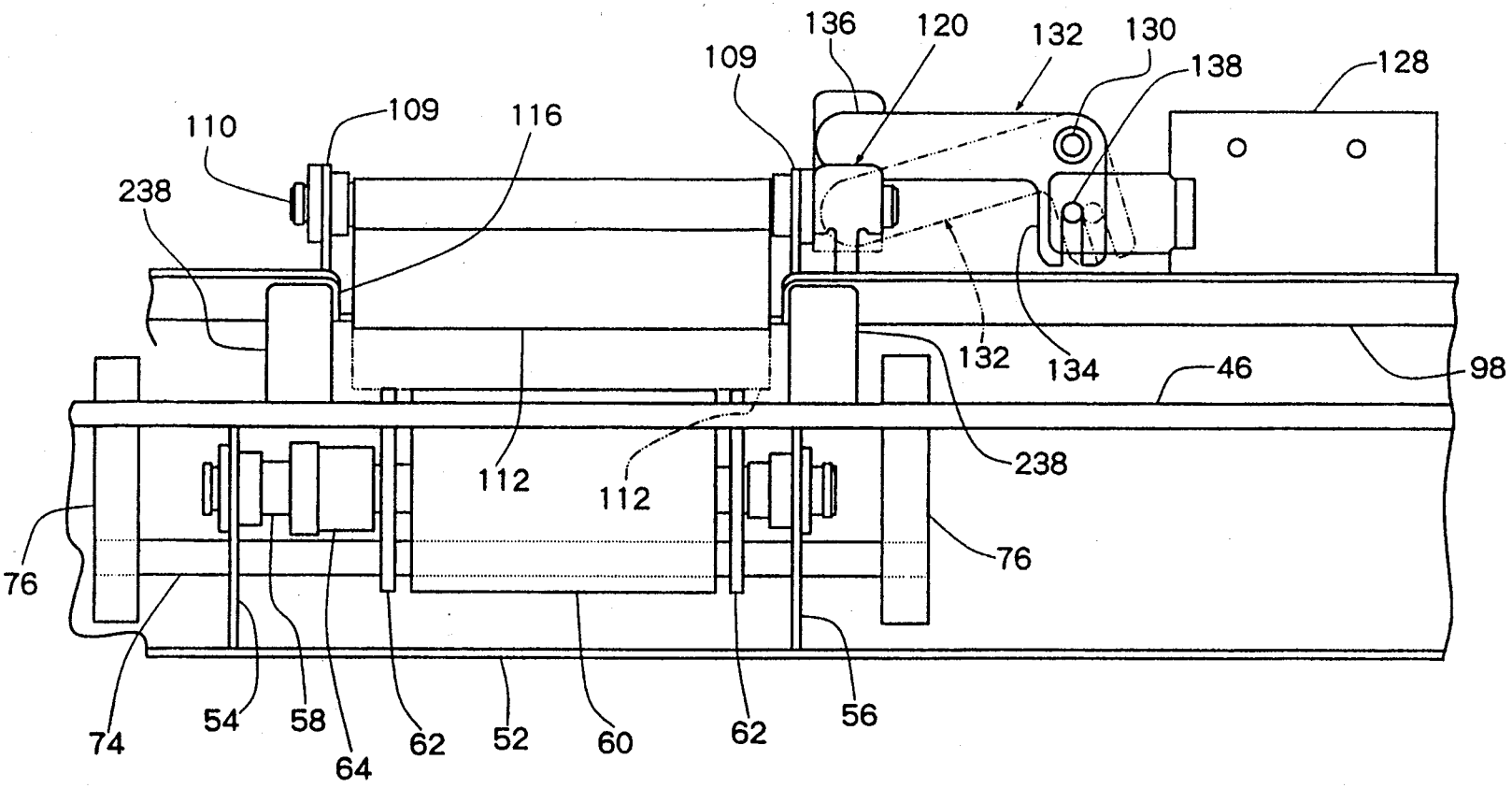
FIG. 5 is a top plan view showing a carrying roller and a pressing member and their related constituent elements in the automatic document conveying apparatus of FIG. 1.

It can be understood by reference to FIG. 4 that the upstanding front wall portion 14 of the frame member 12 has an upstanding front side plate 38 and a front cover 40 covering the front surface of the upstanding front side plate 38, and similarly, the upstanding rear wall portion 16 of the frame member 12 has an upstanding rear side plate 42 and a rear cover 44 covering the upstanding rear side plate 42. Referring to FIG. 3, guide plates 46 and 48 are mounted between the upstanding front side plate 38 and the upstanding rear side plate 42. Between the upstanding front side plate 38 and the upstanding rear side plate 42, a guide plate 51, to which a cover member 50 is annexed, is mounted. The main portion of the guide plate 51 extends vertically face to face to a lower half portion of the guide plate 48. With reference to FIGS. 3 and 5, a supporting plate 52, extending in the width direction between the upstanding front side plate 38 and the upstanding rear side plate 42, is disposed beneath the guide plate 46. The supporting plate 52 has a pair of upstanding supporting walls 54 and 56 formed spaced apart in the width direction. A shaft member 58 is rotatably mounted between the pair of the upstanding supporting walls 54 and 56, and a carrying roller 60 is fixed to the shaft member 58. Conveniently, the carrying roller 60 is formed of a relatively soft material such as synthetic rubber. Desirably, on both sides of the carrying roller 60, collar members 62 are rotatably mounted on the shaft member 58. The collar members 62 may be formed from a relatively rigid material such as a suitable synthetic resin, for example, a polyacetal resin. Preferably, the outer diameter D2 of the collar members 62 is substantially the same as, or somewhat smaller than, the outer diameter D1 of the carrying roller 60 positioned between them ($D1 \geqq D2 \geqq D1-0.1$ mm). Such collar members 62 and especially their functional effect will be described later. A pulley 64 is further fixed to the shaft member 58, and a timing belt (not shown) is wound on the pulley 64. This timing belt may be driven and linked to a carrying portion driving means 68 (FIGS. 2 and 9), which may be an electric motor, through a transmission means containing a carry clutch 66 (FIG. 9), which may be an electromagnetic clutch, and the carrying roller 60 is selectively driven to rotate counterclockwise in FIGS. 2 and 3. The carrying roller 60 and the collar members 62 disposed on both sides thereof are projected upwardly through an opening formed in the guide plate 46. Although not shown in FIG. 5, a shaft member 70 (FIG. 3) is rotatably mounted on the pair of the upstanding supporting walls 54 and 56. A feed roller 72 (FIG. 3) formed from a suitable material such as synthetic rubber is fixed to the shaft member 70. The shaft member 70 is drivingly connected to the carrying portion driving means 68 (FIGS. 2 and 9) via the carrying clutch 66 (FIG. 9), and the feed roller 72 is selectively driven to rotate counterclockwise in FIGS. 2 and 3. The feed roller 72 is also projected upwardly through an opening formed in the guide plate 46. With reference to FIGS. 3 and 5, a shaft member 74, is also rotatably mounted between the pair of upstanding supporting walls 54 and 56, and a pair of stopper members 76 are fixed to the shaft member 74. The stopper members 76 are located outside of the carrying roller 60 and the collar members 62 in a widthwise direction. An electromagnetic solenoid 77 (FIG. 9) is connected to the shaft member 74, and by the action of the electromagnetic solenoid 77, the stopper members 76 are selectively positioned between an acting position shown by a solid line in FIG. 3 and a non-acting position shown by a two-dotted chain line in FIG. 3. When the stopper members 76 are positioned at the acting position, the forward end portions of the stopper members 76 are projected upwardly through the opening formed in the guide plate 46 between the carrying roller 60 and the feed roller 72. When the stopper members 76 are positioned at the non-acting position, the forward end portions of the stopper members 76 are withdrawn downwardly of the guide plate 46.

With reference to FIG. 3, a delivery roller 78 is rotatably mounted between the upstanding front side plate 38 and the upstanding rear side plate 42 in relation to the guide plate 48. The delivery roller 78 is projected toward the left direction in FIG. 3 through an opening formed in the guide plate 48. The delivery roller 78 is drivingly connected to the carrying portion driving means 68 via a delivery clutch 80 (FIG. 9), and in FIGS. 2 and 3, is selectively driven to rotate counterclockwise. Between the upstanding front side plate 38 and the upstanding rear side plate 42 in relation to the guide plate 48, document detectors 82, 84 and 86 (see also FIG. 9) are disposed widthwise at intervals in a somewhat upstream position of the delivery roller 78. These document detectors 82, 84 and 86 are constructed of reflection-type optical detectors including an emitting element and a receiving element, and via an opening formed in the guide plate 48, they detect a document delivered along the guide plate 48. Furthermore, a pressing roller 88 and a document detector 90 are disposed in relation to the guide plate 51. The pressing roller 88 is mounted via a mounting member 92 formed of a spring steel, and by the resilient biasing action of the mounting member 92, it is pressed against the delivery roller 78 through an opening formed in the guide plate 51. The document detector 90 is also made of a reflection-type optical detector including an emitting element and a receiving element, and detects a document delivered along the guide plate 51 through an opening formed in the guide plate 51.

With reference to FIGS. 3 and 4, the opening and closing frame member 36 disposed between the upstanding front wall portion 14 and the upstanding rear wall portion 16 includes a main member 94 and a cover member 96. As clearly shown in FIG. 4, the main member 94 includes a guide plate 98 extending widthwise and a front wall plate 100 and a rear wall plate 102 fixed to both sides of the guide plate 98. A cylindrical short shaft 104 which substantially extends horizontally is mounted in the upstanding front side plate 38 in the main frame 10, and a cylindrical short shaft 106 which substantially extends horizontally is also mounted in the upstanding rear side plate 42 in the main frame 10. The front wall plate 100 of the opening and closing frame member 36 is rotatably mounted on the short shaft 104, and the rear wall plate 102 of the opening and closing frame member 36 is rotatably mounted on the short shaft 106. Thus, the opening and closing frame member 36 is mounted on the main frame 10 and is pivotable about a pivoting axial line (that is, the central axial line of the short shafts 104 and 106), which extends substantially horizontally, between a closed position shown by a solid line in FIG. 3 and an open position shown by a two-dotted chain line in FIG. 3. When the opening and closing frame member 36 is positioned at the closed position, a document carrying passage 108 is defined. More specifically, the upstream portion of the document carrying passage 108 is defined between the Guide plate 46 disposed in the main frame 10 and the Guide plate 98 disposed on the opening and closing frame member 36, and the downstream portion of the document carrying passage 108 is defined between the Guide plate 48 and the guide plate 51 disposed on the main frame 10.

Figure 6:
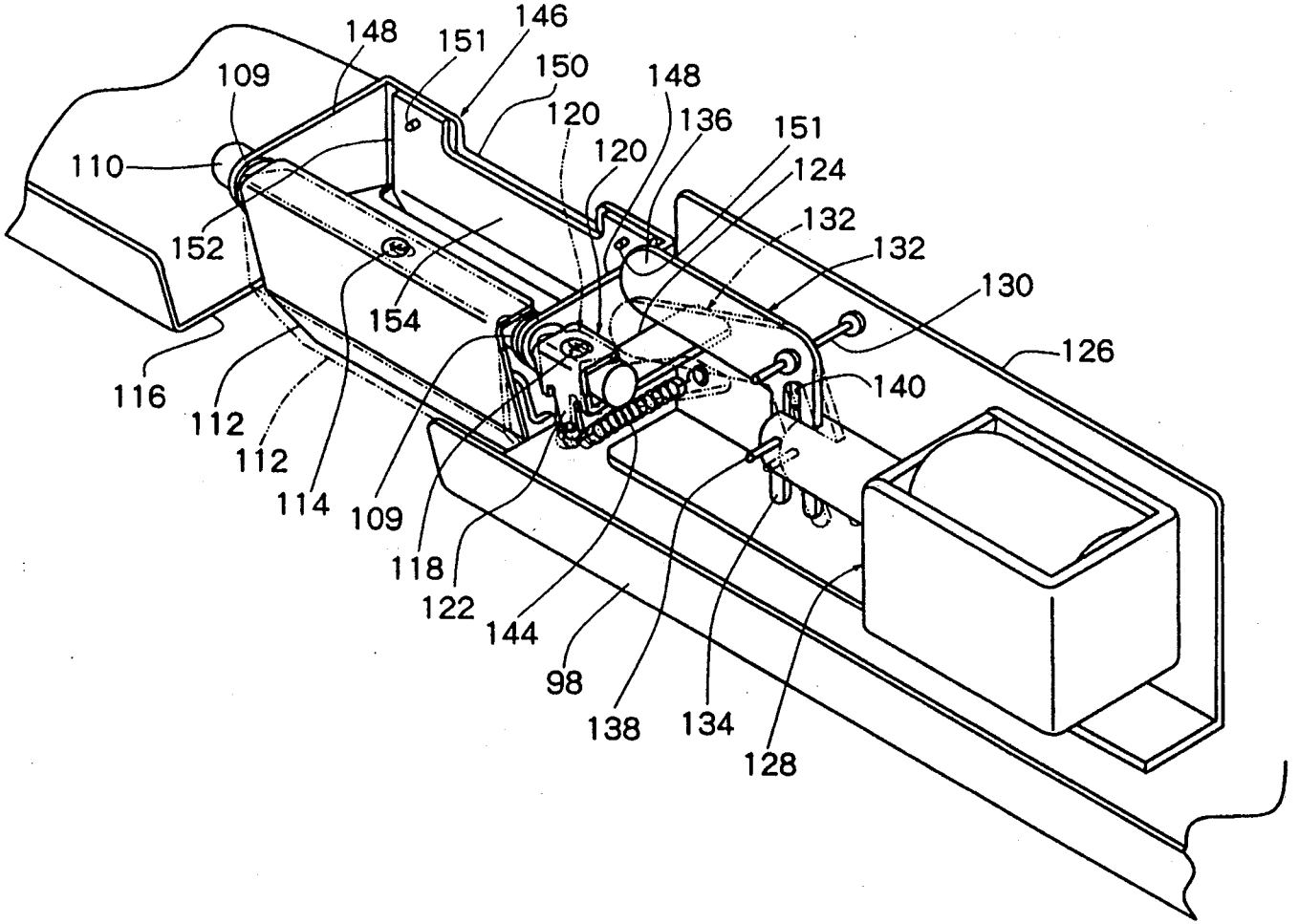
FIG. 6 is a partial perspective view showing a carrying roller and a pressing member and their related constituent elements in the automatic document conveying apparatus of FIG. 1.

With reference to FIG. 6 together FIGS. 3 to 5, there are provided a pair of projecting pieces 109 projected upwardly, spaced widthwise at a distance, on the upper surface of the upstream end portion (right end portion in FIG. 3) of the guide plate 98 in the opening and closing frame member 36. A shaft member 110 is rotatably mounted between the pair of the projecting pieces 109. A pressing member 112, formed preferably from a relatively rigid material, e.g., a suitable metal such as a steel sheet or a suitable synthetic resin such as polyacetal, is fixed to the shaft member 110. The pressing member 112 is fixed at its upper end portion to the shaft member 110 by a set screw 114. A recess 116 is formed centrally widthwise in the upstream portion of the guide plate 98, and the main portion of the pressing member 112 extends downwardly and downstream in a required form and is projected beneath the guide plate 98 through the recess 116 of the guide plate 98. One end portion of the shaft member 110 is projected outwardly widthwise, and an input member 120 is fixed to its projecting end portion by a set screw 118. This input member 120 has a downwardly projecting connecting portion 122 and a contacted portion 124 projecting on the downstream side. As clearly shown in FIG. 6, a mounting bracket 126 having an L-shaped cross section is fixed to the upper surface of the guide plate 98 adjacent to the pressing member 112. The main body portion of an electromagnetic solenoid 128 is mounted on the mounting bracket 126. A pin member 130 is fixed to the upstanding wall portion of the mounting bracket 126, and a transmission member 132 is pivotably mounted on the pin member 130. The transmission member 132 has a first arm 134 that downwardly projects and a second arm 136 that projects inwardly in the width direction. The first arm 134 is inserted into a notch formed in the output rod of the electromagnetic solenoid 128, and by inserting a linking pin 138 that extends through the output rod of the electromagnetic solenoid 128 into a slit 140 formed in the first arm 134, the first arm 134 of the transmission member 132 is pivotably connected to the output rod of the electromagnetic solenoid 128. The second arm 136 of the transmission member 132 extends above the contacted portion 124 of the input member 120. Furthermore, a tension coil spring 144 is provided between the upstanding wall portion of the mounting bracket 126 and the linking portion 122 of the input member 120. When the electromagnetic solenoid 128 is in the deenergized state, the pressing member 112 is positioned in a non-acting position shown by a solid line in FIGS. 2 and 3 by the resilient biasing action of the spring 144. In this non-acting position, the forward end portion of the pressing member 112 is isolated upwardly from the peripheral surface of the carrying roller 60, and is brought into contact with the lower surface of the guide plate 98. When the electromagnetic solenoid 128 is energized to draw back the output rod, as is shown by a two-dotted chain line in FIG. 6, the transmission member 132 is pivoted counterclockwise as seen on an upstream side, and the second arm 136 of the transmission member 132 comes into contact with the contacted portion 124 of the input member 120 to move it downwardly. Accordingly, the shaft member 110 to which the pressing member 112 is fixed is rotated counterclockwise in FIG. 3, and thus, the pressing member 112 is biased toward the carrying roller 60 by a biasing force defined by the magnetic shrinking force of the electromagnetic solenoid 128.

As is clearly shown in FIG. 5, the length of the pressing member 112 in the widthwise direction is larger than the length of the carrying roller 60 in the widthwise direction, and both end portions of the pressing member 112 are located oppositely to the collar members 62. As described later, a plurality of documents are laid in the stacked state on the document placing means 18, and the front end portions of such plural documents are inserted between the carrying roller 60 as well as the collar members 62 and the pressing member 112, and pressed onto the peripheral surface of the carrying roller 60 and the collar members 62 by the pressing member 112. The carrying roller 60 is formed of a relatively soft material such as synthetic rubber, whereas the collar members 62 are formed of a relatively rigid material such as a synthetic resin. Furthermore, since the outer diameter of the collar members 62 rotatably mounted is substantially equal to, or a little smaller than, the outer diameter of the carrying roller 60, the pressing force exerted on a document by the pressing member 112 (such pressing force is stipulated by a magnetic shrinking force of the electromagnetic solenoid 128) and its specified portion of the pressing force (such specified portion is specified by an elastic deformation of the carrying roller 60) is transmitted to the carrying roller 60, and the remainder of the pressing force is transmitted to the collar members 62,. Even when the pressing force varies by the variation of the thickness of documents in the stacked state, the pressing force transmitted to the carrying roller 60 is maintained nearly constant, and the variation of the pressing force varied by the thickness of the documents results in a variation of the pressing force transmitted to the collar members 62. Hence, even when the thickness of documents in the stacked state varies, the pressing force transmitted to the carrying roller 60, namely the pressing force between the lowermost document among documents in the stacked state and the peripheral surface of the carrying roller, is maintained nearly constant. Accordingly, as will be stated later, by rotating the carrying roller 60 counterclockwise in FIGS. 2 and 3, the lowermost document among documents in the stacked state can be carried to the carrying passage fully stably. When the collar members 62 are not disposed on both sides of the carrying roller 60, the pressing force to be transmitted to the peripheral surface of the carrying roller 60 varies greatly by the variation of documents in the stacked state, and the carrying action of the document by the rotation of the carrying roller 60 tends to become unstable.

As shown in FIGS. 3 and 4, a document detector 145 composed of a microswitch is mounted on the upper surface of the upstream end portion of the guide plate 98. The detecting arm of the document detector 145 is projected downwardly through an opening formed in the guide plate 98, and as will be described later, detects the document placed on the document placing means 18.

With reference to FIGS. 3, 4 and 6, a pivoting member 146 is also mounted on the shaft member 110 to which the pressing member 112 is fixed. As illustrated clearly in FIG. 6, the pivoting member 146 has a pair of arms 148 extending at an interval widthwise parallel to each other and a supporting wall portion 150 connecting the arms 148. A free end portion of each of the arms 148 is pivotably mounted on the shaft member 110, and thus, the pivoting member 146 is pivotably mounted on the shaft member 110. A restriction member 152 is fixed to the inner surface of the supporting wall portion 150 of the pivoting member 146 by a pair of set screws 151. The restriction member 152 is composed of a rigid metal plate portion 154 and a synthetic rubber portion 156. The metal plate portion 154 has a mounting portion extending downwardly along the inner surface of the supporting wall portion 150 of the pivoting member 146 and a supporting portion extending downwardly inclinedly in the downstream side following the mounting portion, and the rubber plate portion 156 is adhered to the supporting portion. It is understood by reference to FIG. 3 that the lower half portion of the restriction member 152 is projected downwardly through an opening formed in the guide plate 98. As shown clearly in FIGS. 4 and 7, a mounting bracket 162 having an L-shaped cross section is fixed, correspondingly to the mounting bracket 126, to the upper surface of the guide plate 98. The mounting bracket 126 and the mounting bracket 162 extend in alignment widthwise, and the pivoting member 146 is arranged between the mounting bracket 126 and the mounting bracket 162 with widthwise direction. A sliding member 164 is mounted on the upstanding wall portions of the mounting brackets 126 and 162 so that it can be freely moved widthwise. More specifically, as clearly shown in FIG. 4, slits 166 and 168 extending widthwise are formed widthwise at an interval on the sliding member 164, and guide screw members 170 and 172 are screwed to the upstanding wall portions of the mounting brackets 126 and 162 through the slits 166 and 168. The guide screw members 170 and 172 have guide shaft portions having outer diameters corresponding to the widths of the slits 166 and 168, and when the slits 166 and 168 are guidedly moved with respect to the guide screw members 170 and 172, the sliding member 164 is slidably moved widthwise. A guided pin 174 projecting in a downstream direction is fixed to the outer surface of the supporting wall portion 150 of the pivoting member 146 to which the restriction member 152 is fixed. On the other hand, a guide slit 176 having a lower portion 178 and an upper portion 180 connected to each other via an inclined portion is formed in the sliding member 164, and the guided pin 174 is inserted in the guide slit 176. A tension coil spring 182 constituting an elastic biasing means is provided between one end of the sliding member 164 and the mounting bracket 162. A main body portion of an electromagnetic solenoid 184 constituting a state changing means is fixed onto the guide plate 98 which is adjacent to the other end of the sliding member 164. The output rod of the electromagnetic solenoid 184 is connected to the other end portion of the sliding member 164 via a linking pin 185. When the electromagnetic solenoid 184 is de-energized, the elastic biasing action of the spring 182 positions the sliding member 164 at a non-changing position shown by a solid line. In this case, the guided pin 174 disposed in the pivoting member 146 is positioned in the lower portion 178 of the guide slit 176 of the sliding member 164. At this time, the restricting member 152 is positioned at an acting position shown by a solid line in FIG. 3, and the forward end of the restriction member 152 approaches or contacts the peripheral surface of the above-mentioned feed roller 72 (continuous document conveying state). When the electromagnetic solenoid 184 is energized, the sliding member 164 is moved to a changing position shown by a two-dotted chain line against the elastic biasing action of the spring 182. In this case, the guided pin 174 disposed in the pivoting member 164 is positioned in the upper portion 180 from the lower portion 178 of the guide slit 174 of the sliding member 164. This somewhat pivots the restriction member 152 clockwise in FIG. 3 to the non-acting position shown by a two-dotted chain line in FIG. 3, and the forward end of the restriction member 152 is isolated from the peripheral surface of the feed roller 72 (single document conveying state).

With reference to FIGS. 3 and 4, a mounting bracket 186 is further fixed to the upper surface of the guide plate 98. A pair of projecting pieces 188 projecting upwardly are formed at an interval widthwise, and a supporting bracket 190 is pivotably mounted on the projecting pieces 188. The supporting bracket 190 has a pair of side wall portions 192 disposed at an interval widthwise and an upper wall portion 194 extending between the side wall portions 192, and one end portion of each of the side wall portions 192 is pivotably connected to the projecting pieces 188 of the mounting bracket 186 via a short shaft 196. A shaft member 198 is rotatably mounted between the other end portions of the side wall portions 192. A separation roller 202 is mounted to the shaft member 198 via a torque limiter 200 restricting the transmission torque in the counterclockwise direction in FIG. 3 (in a reverse direction to the document conveying direction) to a predetermined value. Conveniently, the separation roller 202 is formed of a suitable synthetic rubber. A projecting piece 204 projecting upwardly in an downstream side of the recess 116 is formed in an upstream end portion of the guide plate 98. A tension coil spring 206 is provided between the projecting piece 204 and the upper wall portion 194 of the supporting bracket 190. The separation roller 202 mounted on the supporting bracket 190 is projected downwardly through an opening 208 formed in the guide plate 98, and by the elastic biasing action of the spring 206 it is pressed against the feed roller 72.

Figure 7:
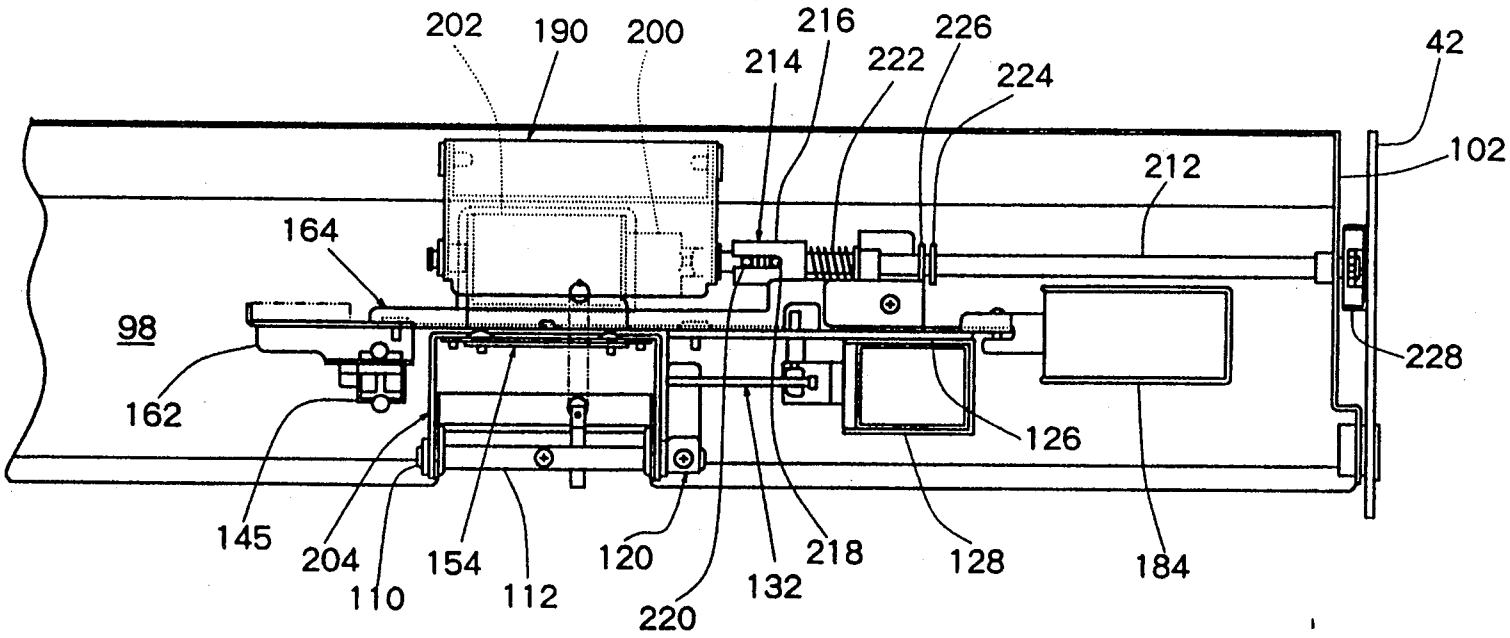
FIG. 7 is a top plan view showing a power transmission shaft and a transmission gear and their related constituent elements in the automatic document conveying apparatus of FIG. 1.

With reference to FIGS. 4 and 7, a mounting piece 210 is fixed to the upper surface of the guide plate 98 in the rear of the opening 208. A transmission shaft 212 is mounted rotatably and movably in the axial direction between the mounting piece 210 and the rear wall plate 102 of the main member 94. The shaft member 198 is connected to the inner end portion of the transmission shaft 212 via a joint means 214. The joint means 214 is constructed of a known pin joint, and includes a connecting sleeve 216 mounted to the inside end portion of the transmission shaft 212, a connecting pin 218 fixed to the inside end portion of the transmission shaft 212 and inserted through a slit of the connecting sleeve 216, and a connecting pin 220 fixed to the end portion of the shaft member 198 and inserted through a slit of the connecting sleeve 216. Between the mounting piece 210 and the connecting sleeve 216, a compression coil spring 222 is fitted on the transmission shaft 212. Such spring 222 elastically biases the connecting sleeve 216, or the transmission shaft 212 inwardly widthwise, and resiliently maintains the connection between the transmission shaft 212 and the shaft member 198 via the joint means 214.

Figure 8:
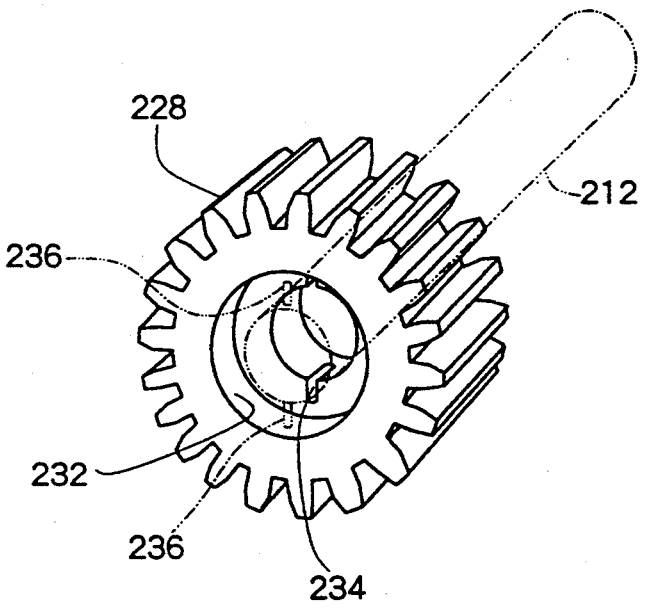
FIG. 8 is a partial perspective view showing the correlation between a power transmission shaft and a transmission gear in the automatic document conveying apparatus of FIG. 1.
Figure 9:
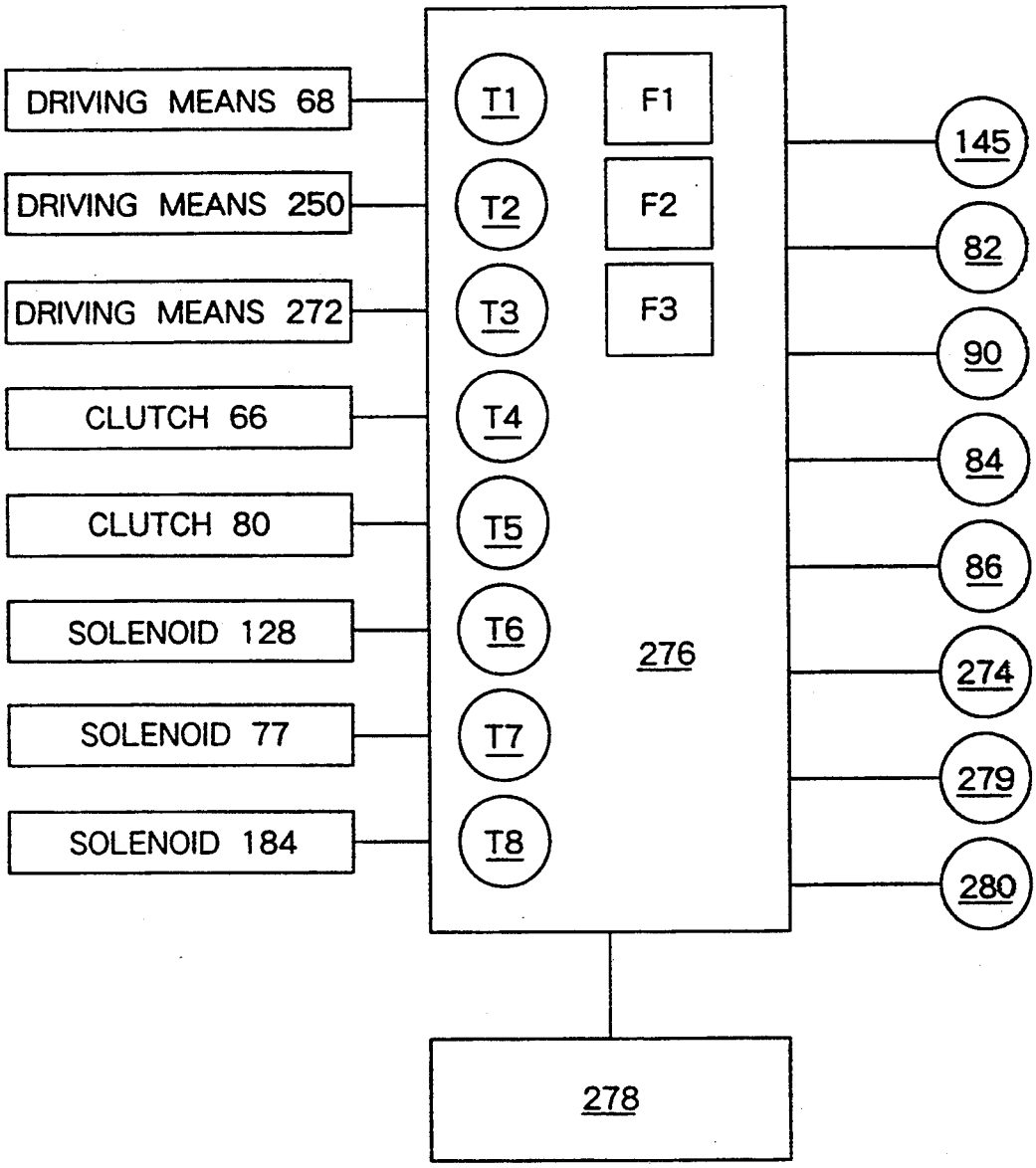
FIG. 9 is a simplified block diagram showing elements related to a control system in the automatic document conveying apparatus of FIG. 1.
Figure 10:
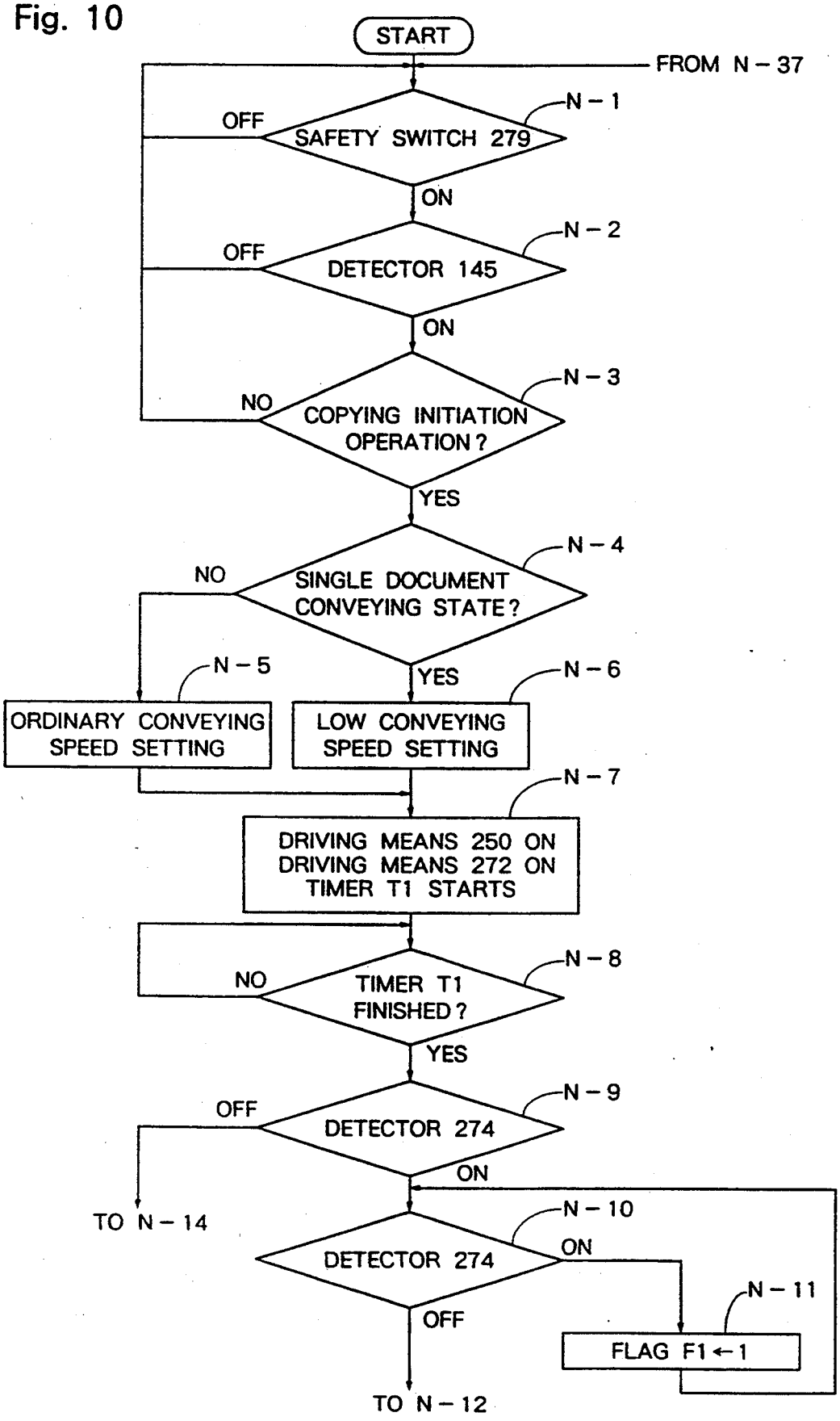
FIG. 10 is a part of a main routine of a flow chart for illustrating the operating sequence of the automatic document conveying apparatus of FIG. 1.
Figure 11:
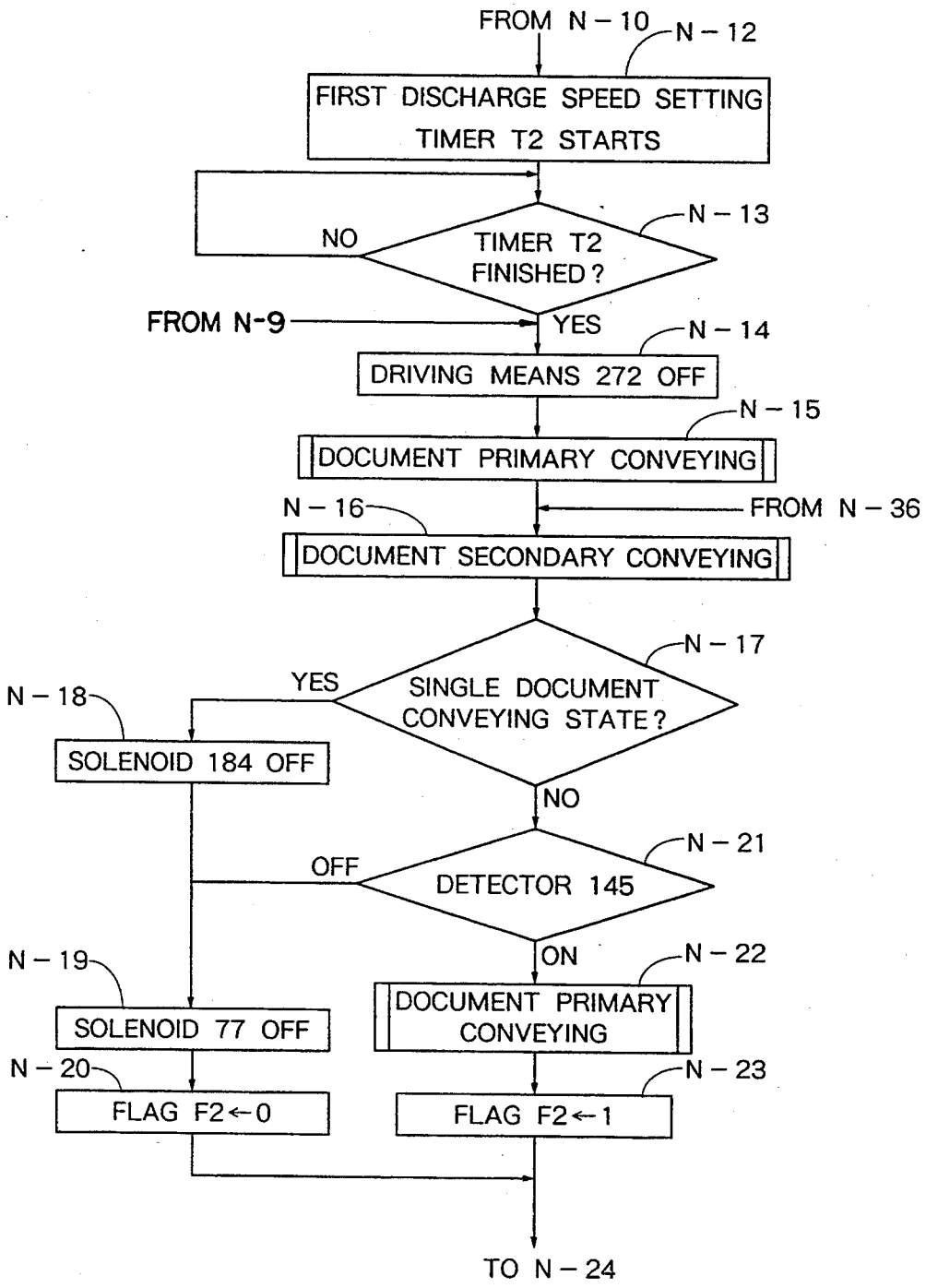
FIG. 11 is a further part of a main routine of a flow chart for illustrating the operating sequence of the automatic document conveying apparatus of FIG. 1.
Figure 12:
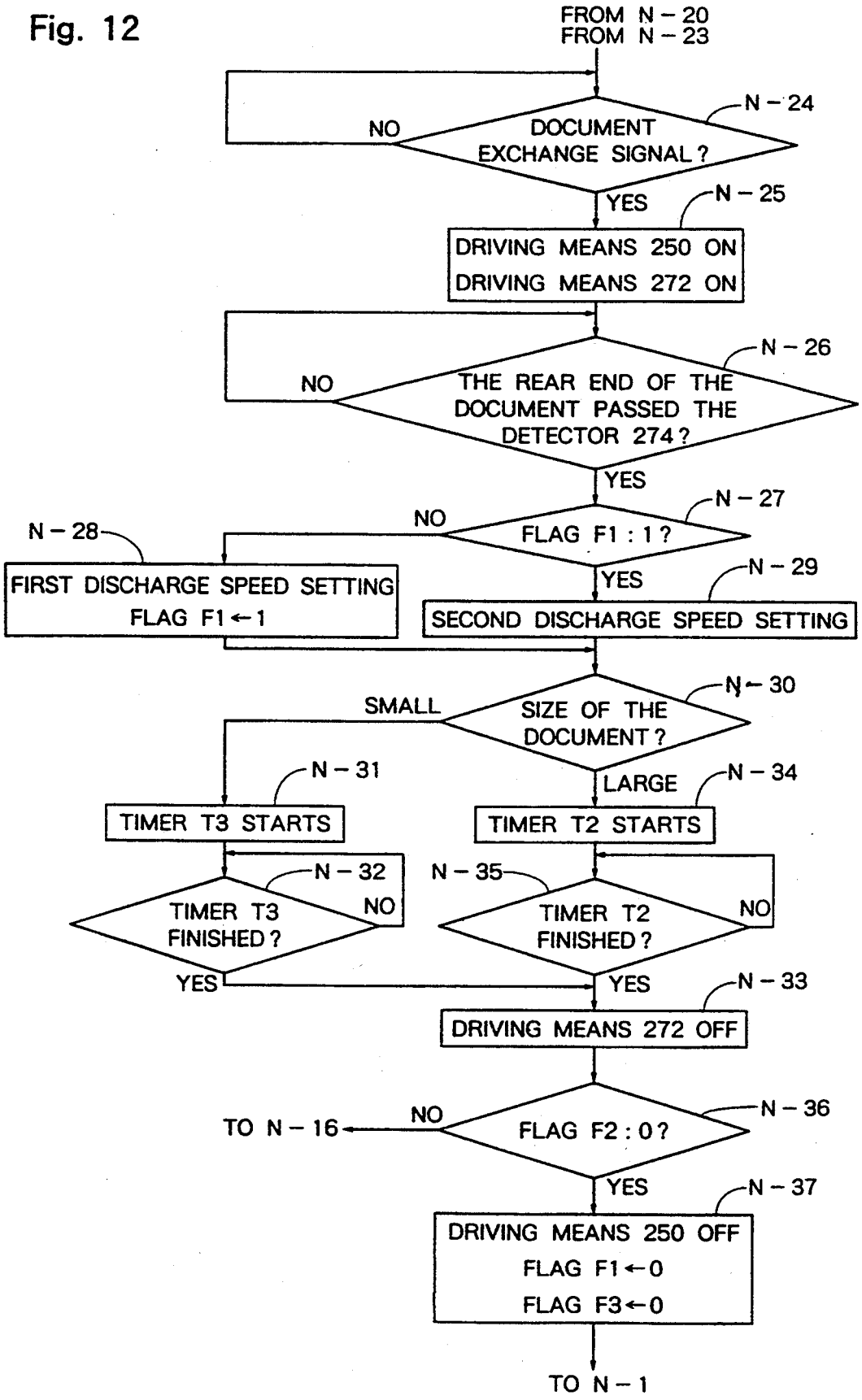
FIG. 12 is a further part of a main routine of a flow chart for illustrating the operating sequence of the automatic document conveying apparatus of FIG. 1.
Figure 13:
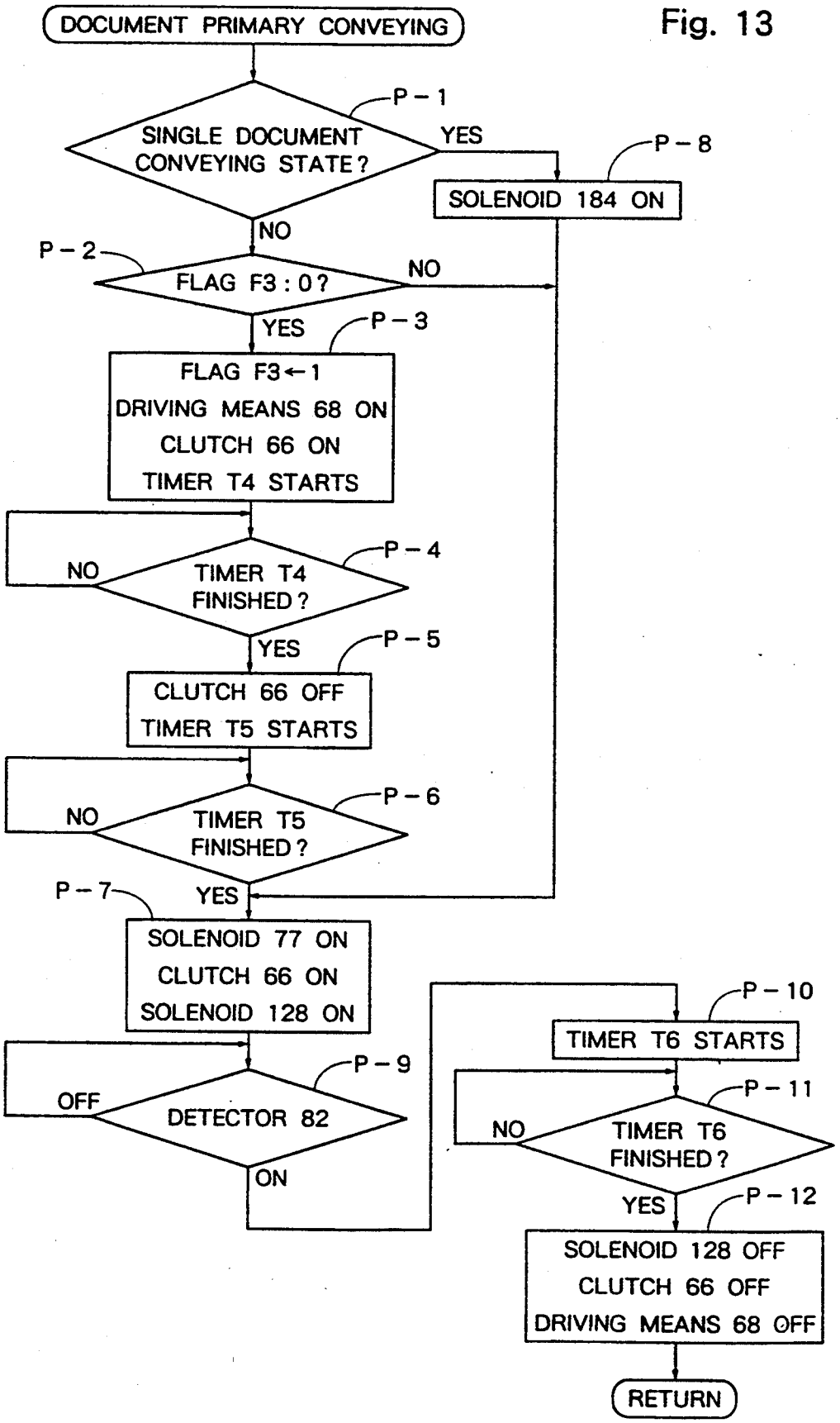
FIG. 13 is a document primary conveying sub-routine of a flow chart for illustrating the operating sequence of the automatic document conveying apparatus of FIG. 1.
Figure 14:
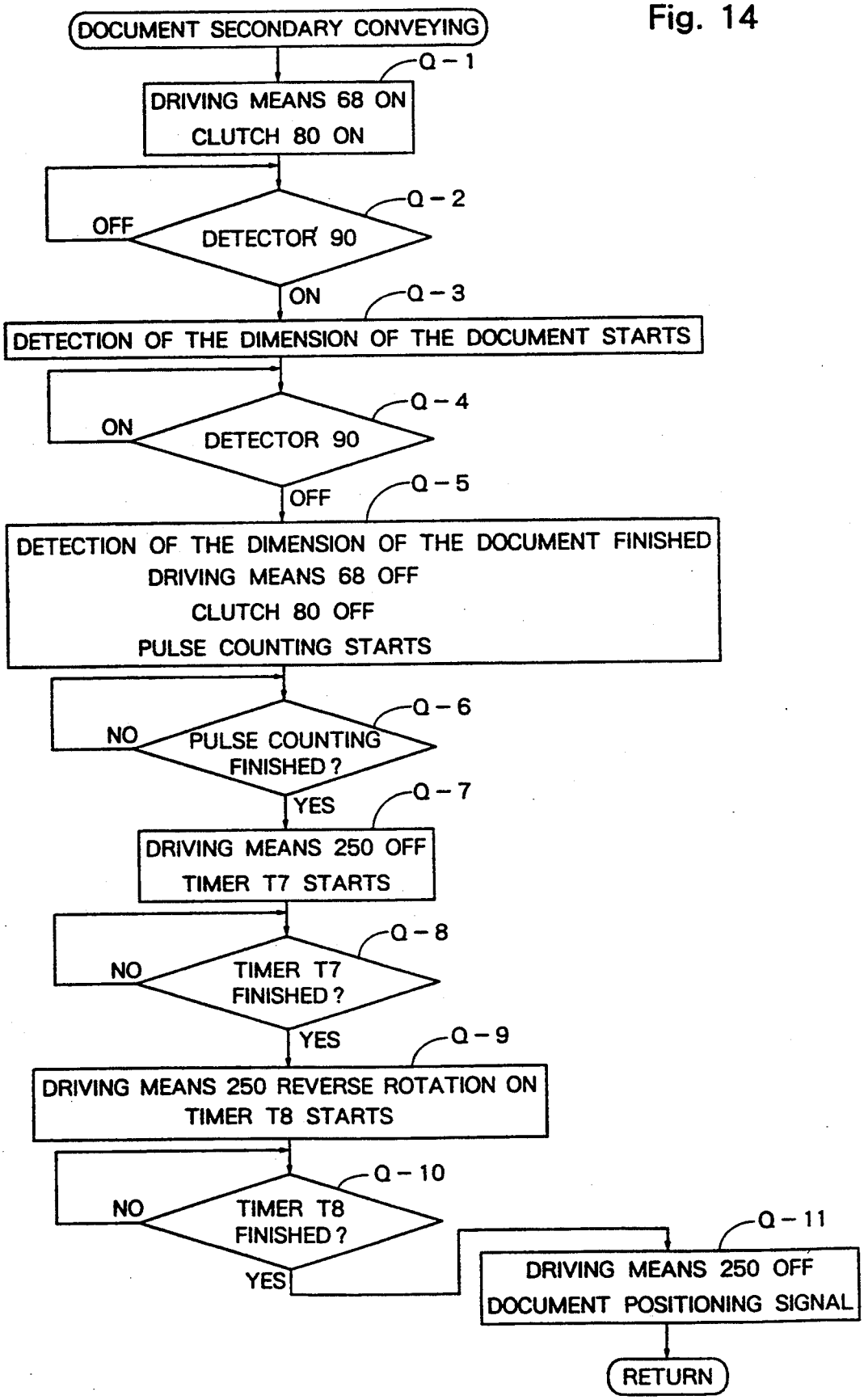
FIG. 14 is a document secondary conveying sub-routine of a flow chart for illustrating the operating sequence of the automatic document conveying apparatus of FIG. 1.

A flange member 224 is also fixed to the transmission shaft 212. An interlocking member 226 is fixed to the sliding member 164 correspondingly to the flange member 224. The interlocking member 226 has formed therein a suspending portion having a notch which receives the transmission shaft 212, and such suspending portion strides the transmission shaft 212 adjacent to the flange member 224. When the electromagnetic solenoid 184 is de-energized and the sliding member 164 is positioned at a non-changing position shown by a solid line shown in FIG. 4, the suspending portion of the interlocking member 226 is isolated, inwardly in the widthwise direction, from the flange member 224 of the transmission shaft 212, and the transmission shaft 212 is maintained at a connecting position shown by a solid line in FIG. 3. On the other hand, when the electromagnetic solenoid 184 is energized and the sliding member 164 is moved to a changing position shown by a two-dotted chain line shown in FIG. 4, the suspending portion of the interlocking member 226 comes into contact with the flange member 224, and the transmission shaft 212 is moved outwardly to some extent in the widthwise direction against the elastic biasing action of the coil spring 222 to place it at an isolated position. The outer end portion of the transmission shaft 212 goes through the rear wall plate 102 in the main portion 94 of the opening and closing frame member 36, and is projected between the rear wall plate 102 and the upstanding rear side plate 42 of the main frame member 10. A transmission gear 228 is movably mounted in the axial direction at the projecting end portion of the transmission shaft 212. The transmission gear 228 is connected to the carrying portion driving means 68 (FIGS. 2 and 9) via a suitable transmission means (not shown) containing other transmission gears and the carrying clutch 66 (FIG. 9). As clearly illustrated in FIG. 8, an annular concave portion 232 is formed on the outer surface of the transmission gear 228, and a groove 234 extending diametrically is formed in the bottom surface of the annular concave portion 232. On the other hand, a transmission pin 236 extending diametrically is mounted on the projecting end portion of the transmission shaft 212. When the above electromagnetic solenoid 184, constituting the state-changing means, is de-energized and the transmission shaft 212 is maintained at a connecting position, the transmission pin 236 of the transmission shaft 212 is positioned within the groove 234 of the transmission gear 228. Accordingly, the transmission shaft 212 is drivingly connected to the transmission gear 228, and the separation roller 202 mounted on the shaft member 198 is connected to the carrying portion driving means 68 via the torque limiter 202, the transmission shaft 212, the transmission gear 228, and the carrying clutch 66 (continuous document conveying state). On the other hand, when the electromagnetic solenoid 184 is energized and the transmission shaft 212 is moved to the separation position outwardly in the widthwise direction, the transmission pin 236 of the transmission shaft 212 is isolated from the groove 234 of the transmission gear 228 and is positioned within the annular concave portion 232. As a result, the transmission shaft 212 can be rotated freely with respect to the transmission gear 228, and accordingly the separation roller 202 mounted on the shaft member 198 can be freely rotated in the document conveying direction (clockwise in FIG. 3) (single document conveying state). When the electromagnetic solenoid 184 is de-energized, the transmission pin 236 of the transmission shaft 212 is again advanced in the groove 234 of the transmission gear 228 and the transmission shaft 212 is drivingly connected to the transmission gear 228. When the electromagnetic solenoid 184 is de-energized but the transmission pin 236 of the transmission shaft 212 is not adjusted in an angular position to the groove 234 of the transmission gear 228, the transmission pin 236 cannot be advanced in the groove 234. However, when the transmission gear 228 begins to be rotated by the carrying portion driving means 68 (FIG. 9), the groove 234 is immediately adjusted to the transmission pin 236, and the transmission pin 236 is advanced in the groove 234.

With reference to FIGS. 3 and 5, a pair of guide members 238 are disposed in an upstream portion of the document carrying passage 108. The guide members 238 are formed from a suitable synthetic resin film such as a polyester film. As can be understood from FIG. 5, each of the guide members 238 is disposed between the pressing member 112 and the stopper member 76. As illustrated clearly in FIG. 3, the guide member 238 is adhered, at the upstream end portion thereof, to the under surface of the upstream end portion of the guide plate 98 disposed in the opening and closing frame 36, and extends inclinedly downwardly from the upstream end portion in a downstream direction. Its downstream end portion contacts the upper surface of the guide plate 46 disposed in the main frame member 10. The downstream end portion of the guide member 238 passes below the forward end of the restriction member 152 and extends below the nip site between the feed roller 72 and the separation roller 202. Such a pair of the guide members 238 properly guide a document that is placed on the document placing means 18 and carried in the document carrying passage 108, and effectively prevent clogging of the document. Furthermore, the formation of an undesirable deformation or crease in the document is effectively prevented on both surfaces of the carrying roller 60 and the pressing member 112. When the guide members 238 are not provided, and especially if the document is curved upwardly at a front portion, the forward end portion of the document carried in the document carrying passage 108 does not contact the peripheral surface of the feed roller 72, but contacts only the separation roller 202 and/or the restriction member 152, so that the advance of the document is impeded and clogging of the document tends to occur. Furthermore, when the guide members 238 are not provided, and especially if the document has a relatively weak stiffness and is large in size, the document tends to be curved in a wavy form or to be creased on both areas of the central portion of the document pressed by the peripheral surface of the carrying roller 60 due to the action of the pressing member 112.

With reference to FIG. 2, a conveying belt mechanism designated generally at 240 is disposed in the under portion of an open under-surface of the frame member 12 in the main frame 10. This conveying belt mechanism 240 includes a driven belt roller 242, a follower belt roller 244 disposed at an interval in the conveying direction, and an endless belt 246 wound on the driven belt roller 242 and the follower belt roller 244. A plurality of pressing rollers 248 are also disposed in the conveying belt mechanism 240. Furthermore, the driven belt roller 242 is drivingly connected, via a suitable transmission means (not shown), to a transfer portion driving means 250 which may be an transmission motor, and the transfer portion driving means 250 rotatingly drives the conveying belt mechanism 240 in a required direction. The construction of the conveying belt mechanism 240 may be of any known form, and therefore a detailed description of the construction of the conveying belt mechanism 240 itself will be omitted. As shown in FIG. 2, when the main frame 10 is positioned in the closing position, the lower side running portion of the endless belt 246 in the conveying belt mechanism 240 is positioned along the transparent plate 8 of the electrostatic copying machine 4, and a document transfer passage 252 is defined between the endless belt 246 and the transparent plate 8. When the conveying belt mechanism 240 is rotatingly driven, a document is transferred through the document transfer passage 252.

With reference to FIG. 2, a document delivery passage 254 following the document transfer passage 252 is defined in a right end bulged portion in the main frame 10. The delivery passage 254 is defined by guide plates 256, 258 and 260, and extends in a nearly inverse-C shape from an upstream end following the document transfer passage 252 to a discharge opening 262 formed in the upstream end of the document receiving means 30. A delivery roller pair composed of a driven roller 264 and a follower roller 266, and a discharge roller pair, composed of a driven roller 268 and a follower roller 270, are provided in the document delivering passage 252. The driven rollers 264 and 268 are drivingly connected to a delivering portion driving means 272, which may be a transmission motor, via a suitable transmission means (not shown), and driven to rotate clockwise in FIG. 2. Furthermore, a document detector 274 for detecting a document through the document delivering passage 254 is disposed in the document delivery passage 254. This document detector 274 may be an optical detector having a light receiving element and a light emitting element.

As illustrated simply in FIG. 9, the operation of the automatic document conveying apparatus 2 mentioned above is controlled by a control means 276 which may be a microprocessor. The control means 276 is connected to a control means 278 of the electrostatic copying machine 4 to which the automatic document conveying apparatus 2 is applied. With reference to the flow charts shown in FIGS. 10 to 14, the operating sequence of the automatic document conveying apparatus 2 will be explained as described in the following.

In step N-1, it is judged whether or not the automatic document conveying apparatus 2 is set in the required state, more specifically it is judged whether or not the main frame 10 is not in the open position shown by a two-dotted chain line shown in FIG. 1 but positioned in the closed position shown by a solid line in FIGS. 1 and 2, and it is judged whether the opening and closing frame member 36 is not at the open state shown by a two-dotted chain line in FIG. 3 but positioned at the closed position shown by a solid line in FIGS. 1, 2 and 3. The above judgements are made by determining whether a plurality of safety switches 279 (FIG. 9), which may be of any known form, are closed or not. When the automatic document conveying apparatus 2 is set in a required state and the safety switch 279 is closed, the operation goes to step N-2, and it is judged whether the document detector 145 detects a document or not. A document to be copied is placed on the document placing means 18 by advancing its forward end portion in an upstream portion of the document carrying passage 108, and the front end of the document comes into contact with the stopper member 76 positioned in an operating position. Hence, when the document is placed as required on the document placing means 18, the document detector 145 detects the document. Then, the operation goes to step N-3, and it is judged whether a copy starting key (not shown) disposed in the electrostatic copying machine 4 is manually operated or not. And then, the operation goes to step N-4, and a state changing switch 280 (FIGS. 1 and 9) disposed on the upper surface of the opening and closing frame member 36 is manually operated, and it is judged whether a single conveying state is selected or not. When usually a plurality of documents are to be copied, the operator can select a continuous document conveying state without manually operating the state changing switch 280. On the other hand, when a document to be copied is an origin of a design drawn on a tracing paper, etc. which has a high importance of avoiding breakage or damage reliably, the operator operates the state changing switch 280 to determine a single document conveying state. When a single document conveying state is not selected and a continuous document conveying state is selected, the operation goes to step N-5, and the output speed of the carrying portion driving means 68, the transfer portion driving means 250 and the delivery portion driving means 272 is set at an ordinary conveying speed V1 (for example, a document conveying speed of about 700 mm/sec.). On the other hand, when a single document conveying state is selected, the operation goes to step N-6, and the output speed of the carrying portion driving means 68, the transfer portion driving means 250 and the delivering portion means 272 is set at a low conveying speed V2 which may be about 60 to 80% of the ordinary speed ($0.6 \times V1 < V2 < 0.8 \times V1$). Thus, the possibility of breaking and damaging a document having high importance by conveying it at a relatively high speed can be fully reliably avoided.

Then, the operation goes to step N-7, and the transfer portion driving means 250 and the delivery portion driving means 272 are energized. Furthermore, the timer T1 included in the control means 276 begins to count timing. In step N-8, it is judged whether the time T1 has counted a predetermined period of time which may be about 800 msec or not. When the timer T1 has counted a predetermined period of time, the operation goes to step N-9, and it is judged whether the document detector 274 disposed on the document delivery passage 254 detects a document or not. When there is a document which has been forgotten on the transparent plate 8 of the electrostatographic copying machine 4, and the transfer portion driving means 250 and the delivery portion driving means 272 are energized in the step N-7, by the action of the conveying belt mechanism 240, the delivering roller pair 264 and 266 and the discharge roller pair 268 and 279, the forgotten document is conveyed through the document transfer passage 252 and the document delivery passage 254, and the document detector 274 detects the document. In this case, the operation goes to step N-10, and it is judged whether the document detector 274 has not detected a document, namely whether the rear end of the document has passed the document detector 274 or not. When the document detector 274 detects the document, the operation goes to step N-11. A flag F1 included in the control means 276 is set at 1. When the document detector 274 no longer detects the document, the operation goes to step N-12, and the output speed of the delivering portion driving means is set at a first discharge speed V3-1 which is conveniently 30 to 40% of an ordinary conveying speed V1 ($0.3\times V1<V3-1<0.4\times V1$), and the timer T2 included in the control means 276 begins to count timing. In step N-13, it is judged whether the timer T2 has counted a predetermined timing which may be about 500 msec (this predetermined timing is a timing suitable for discharging the rear end of the forgotten document which has passed the document detector 274 onto the document receiving means 30). When the timer T2 has counted a predetermined period of time, the operation goes to step N-14, and the delivery portion driving means 272 is deenergized. When the document detector 274 does not detect a document in step N-9, namely when there is no forgotten document on the transparent plate 8 of the electrostatographic copying machine 4, step N-9 directly goes to step N-14.

Then, the operation goes to step N-15 and a document primary conveying is carried out. The document primary conveying will be explained with reference to FIG. 13. It is judged in step P-1 whether a single document conveying state is selected or not. When a continuous document conveying state but not a single document conveying state is selected, the operation goes to step P-2, and it is judged whether the prescribed value of the flag F3 included in the control means 276 is 0 or 1. When the document carried from the document placing means 18 is a first document, the prescribed value of the flag F3 is 0. In this case, the operation goes to step P-3, and the prescribed value of the flag F3 is adjusted to 1. The carrying portion driving means 68 is energized, the carrying clutch 66 is energized, and the timer T4 included in the control means 276 beings to count the timing. Then, in step P-4, it is judged whether the timer T4 has counted a predetermined period of time, which may be about 300 msec, or not. When the carrying portion driving means 68 and the carrying clutch 66 are energized over the period of time until the timer T4 finishes counting, the carrying roller 60 is driven to rotate in the document carrying direction, the document is advanced until the forward end of the document abuts surely on the forward end of the stopper member 76. Furthermore, when a single document conveying state is returned to a continuous document conveying state, the electromagnetic solenoid 184 constituting the state changing means whose operation is to be described later, is de-energized, the transmission shaft 212 is returned to a connecting position, and connected to the transmission gear 228. But when the transmission pin 236 of the transmission shaft 212 and the groove 234 of the transmission gear 228 are not adjusted in an angular position at the time of energizing the electromagnetic solenoid 184, the transmission pin 236 is immediately adjusted to the groove 234 by the rotation of the transmission gear 228 during the time counting of the timer T4, and the transmission pin 236 is advanced in the groove 234. Then, the operation goes to step P-5, and the carrying clutch 66 is de-energized, and the timer T5 included in the control means 276 begins to count. In step P-6, it is judged whether or not the timer T5 has counted a predetermined period of time which may be about 20 msec (such period of time surely ensures that mechanical connection in the de-energized carrying clutch 66 is surely canceled). Then, in step P-7, the electromagnetic solenoid 77 annexed to the stopper member 76 is energized. Therefore, the stopper member 76 is withdrawn to a non-operating position shown by a two-dotted chain line in FIG. 3. Thus, the carrying clutch 66 is again energized, and the electromagnetic solenoid 128 annexed to the pressing member 112 is energized. Therefore, the pressing member 112 is biased toward the carrying roller 60 and pressed against the document. Accordingly, the lowermost one (or several) document (or documents) among those placed in the stacked state on the document placing means 18 is (or are) carried into the document carrying passage 108 by the action of the carrying roller 60 rotated in the document conveying direction. The restricting member 152 approaching or contacting the feed roller 72 rotated in the document conveying direction functions so as to restrict the number of documents fed to a nip position between the feed roller 72 and the separation roller 202 to two documents or less. To a predetermined rotating torque value, the separation roller 202, rotated in a reverse direction to the document conveying direction, conveys only one document further in an downstream direction. In step P-2, when the document to be carried from the document placing means 18 is the second or a subsequent document and the flag F3 is prescribed at 1, the above step P-2 directly goes to step P-7.

When in step P-1 the document to be conveyed has importance, such as an original of a design, and therefore, a single document conveying state is selected, the operation goes from step P-1 to step P-8, and the electromagnetic solenoid 184 constituting the state changing means is energized. Thus, the restriction member 152 is elevated to a non-acting position shown by a two-dotted chain line in FIG. 3 and isolated from the feed roller 72, and the transmission shaft 212 is separated from the transmission gear 228 and the separation roller 202 can be freely rotated in the document conveying direction. Thereafter, the operation goes to step P-7 and the conveying of the document placed on the document placing means 18 is begun. When the electromagnetic solenoid 184 is energized to determine a single document conveying state, the restriction action of the restricting member 152 is canceled. Furthermore, the separation action of the separation roller 202 is canceled, and the possibility of breaking or damaging the document is fully reliably avoided at the time of the restriction action and/or the separation action.

Then, the operation goes to step P-9 from step P-7, and it is judged whether or not the document detector 82 detects the document carried into the document carrying passage 108. When the document detector 82 detects the document, the operation goes to step P-10, and the timer T6 included in the control means 276 begins to count timing. In step P-11, it is judged whether or not the timer T6 has counted a predetermined period of time which may be about 50 msec. When the timer T6 has counted the predetermined period of time, the operation goes to step P-12, the electromagnetic solenoid 128 is de-energized, and the pressing member 112 is returned to a non-acting position. Furthermore, the carrying clutch 60 and the carrying portion driving means 68 are de-energized to stop the rotation of the carrying roller 60, the feed roller 72 and the separation roller 202. Until the timer T6 has counted a predetermined period of time, the forward end the document carried into the document carrying passage 108 is caused to abut on the nip position of the delivery roller 78 and the pressing roller 88 which are at a non-acting position. Thus, the document primary conveying comes to an end, and the main routine is returned.

Then, the step N-16 proceeds, and a document secondary conveying is carried out. The document secondary conveying will be illustrated with reference FIG. 14. In step Q-1, when the carrying portion driving means 68 is energized and also the conveying clutch 80 is energized, the conveying roller 78 is driven to rotate in the document conveying direction, and the primarily conveyed document is further conveyed. Then, the operation goes to step Q-2, and it is judged whether or not the document detector 90 disposed on the downstream end portion of the document carrying passage 108 detects the document. When the document detector 90 detects the document, the operation goes to step Q-3, and the size of the document carried onto the transparent plate 8 begins to be detected. In step Q-4, it is judged whether or not the document detector 90 has not detected the document, that is to say, whether or not the rear end of the document has passed the document detector 90. Then, the operation goes to step Q-5, the detection of the size of the document has been terminated, the carrying portion driving means 68 is de-energized, the delivering clutch 80 is de-energized, and the number of pulses formed in correspondence to the amount of driving of the transfer portion driving means 250 begins to be counted (the transfer portion driving means 250 is energized in the step N-7 and maintained in this condition). Accordingly, in the detection of the size begun in the step Q-3, the width of the document is detected according to whether or not the document detectors 84 and 86, displaced by a predetermined amount length from the center in the width direction in the document carrying passage 108, detect the document. Furthermore, the driving amount of the carrying portion driving means 68 from the detection of the forward end of the document by the document detector 90 to the passing of the rear end of the document over the document detector 90 is detected by counting the number of pulses formed correspondingly to such driving amount, whereby the length of the document in the conveying direction is detected. Then, in step Q-6, it is judged whether or not the counting of time initiated in step Q-5 is performed to a prescribed time. When counting of the predetermined period of time is terminated (at such a time, the rear end of the document has somewhat passed the document rear side positioning site stipulated on an upstream end of the transparent plate 8), the operation goes to step Q-7, the transfer portion driving means 250 is de-energized, and the timer T7, included in the control means 276, begins to count. In step Q-8, it is judged whether or not the timer T, has counted a predetermined period of time which may be 30 msec. When the timer T7 has counted the predetermined period of time, the operation goes to step Q-9, the transfer driving means 250 is reversibly driven to rotate and drive the conveying belt mechanism 240 in a reverse direction relative to a normal document conveying direction (in FIG. 2, a direction moving from right to left), and the timer T8 included in the control means 276 begins to count timing. Then, in step Q-10, it is judged whether or not the timer T8 has counted a predetermined period of time which may be 100 msec. When the timer T8 has counted the predetermined period of time, the operation goes to step Q-11, the transfer portion driving means 250 is de-energized, and reverse rotation of the conveying belt mechanism 240 is stopped. While the timer T8 counts timing, the document is somewhat transferred to the left in FIG. 2, and the rear end of the document is positioned at a document rear end position site stipulated on the upstream end of the transparent plate 8 when the timer T8 terminates counting of time and the conveying belt mechanism 240 is stopped. Furthermore, in step Q-11, a single showing that a document is positioned at a predetermined site on the transparent plate 8 is sent from the control means 278 of the electrostatographic copying machine 4, and a copying process is started in the electrostatic copying machine 4. Thus, the document secondary conveying is terminated, and the main routine is returned.

Then in step N-17 of the main routine, it is judged whether or not a single document conveying state is selected. When the single document conveying state is selected, the operation goes to step N-18, the electromagnetic solenoid 184 constituting the state changing means is de-energized. Accordingly, the restricting member 152 is returned to an operating position, and the transmission shaft 212 is returned to a connecting position. The separation roller 202 can be connected to the carrying portion driving means 68 via the transmission shaft 212 and the transmission gear 228. Then, the operation goes to step N-19, the electromagnetic solenoid 77 is de-energized and the stopper member 67, shown by a solid line in FIGS. 2 and 3, is returned to its acting position. In step N-20, the flag F2 included in the control means is set at 0. Such flag F2 is set at 0 when there is no document primarily conveyed, and when there is a document existing as being primarily conveyed, the flag F2 is set at 1. When instep N-17 not the single document conveying state but the continuous document conveying state is selected, the operation goes to step N-21, and it is judged whether or not the document detector 145 detects a document, namely whether or not a document to be carried remains on the document placing means 18. When the document detector 145 does not detect a document, the operation goes to step N-19. On the other hand, when the document detector 145 detects the document, the operation goes to step N-22 and the document primary conveying is repeatedly carried out. In step N-23, the above flag F2 is set at 1.

Next, in the step N-24, it is judged whether or not the electrostatic copying machine 4 has received a document exchange signal. When exposure of the document in a copying process to a document positioned on the transparent plate 8 is terminated, the electrostatic copying machine 4 produces the document exchange signal. If such a signal is received by the control means 276, the operation goes to step N-25. In step 25, the transfer portion driving means 250 is energized, the conveying belt mechanism 240 is driven to rotate in a normal document conveying direction, furthermore the delivery portion driving means 272 is energized to rotate the delivery roller pairs 264 and 266 and the discharge roller pairs 268 and 270, and thus the document on the transparent plate 8 is conveyed through the document transfer passage 252 and the document delivery passage 254. In step N-26, it is judged whether or not the document detector 274 disposed in the document delivery passage 254 detects the rear end of the document, namely whether or not the rear end of the document conveyed through the document delivery passage 254 passes the document detector 274. When the rear end of the document passes the document detector 274, the operation goes to step N-27, and it is judged whether or not the flag F1 is set at 1. When the document delivered through the document delivery passage 254 is the first document and the flag F1 is set at 0, the operation goes to step N-28. In this step N-28, the output speed of the delivery portion driving means 272 is set at the first discharge speed V3-1 which is preferably about 30% to 40% of the usual conveying speed V1, and the flag F1 is set at 1. On the other hand, when the document delivered through the document delivery passage 254 is the second or subsequent document and flag F1 in step F-27 is set at 1, the operation goes to step N-29. In this step N-29, the output speed of the delivery portion driving means 272 is set at the second discharge speed V3-2 preferably about 20% to 30% of the usual conveying speed V1 ($0.2\times V1<V3-2<0.3\times V1$). Then, in step N-30, it is judged whether or not the document to be delivered is larger than a prescribed size (the size of the document itself will be detected in steps Q-3, Q-4, and Q-5 in the above-mentioned document secondary conveying). When the document to be delivered is smaller than a predetermined size (for example, JIS standard B4), the operation goes to step N-31, and the timer T3 included in the control means 276 begins to count timing. In step N-32, it is judged whether or not the timer T3 has counted a predetermined period of time T-S which may be about 400 msec. When the timer T3 has counted a predetermined period of time, the operation goes to step N-33, the delivery portion driving means 272 is de-energized, and the delivery roller pairs 264 and 266 and the discharge roller pairs 268 and 270 stop to rotate. On the other hand, when a document to be delivered has more than a predetermined dimension in step N-30, the operation goes to step 34, and the timer T4 included in the control means 276 begins to count timing. In step N-35, it is judged whether or not the timer T2 has counted a predetermined period of time T-L which may be about 500 msec. When the timer T2 has counted a predetermined period of time, the operation goes to step N-33. Then, the operation goes to step N-36, and it is judged whether or not the flag F2 is set at 1 or 0. When a document primarily conveyed exists and the flag F2 is set at 1, the operation returns to step N-16, and the secondary conveying of a document is again carried out. When in step N-36 the flag F2 is set at 0, the operation goes to step N-37, the transfer portion driving means 250 is de-energized, the flag F1 is set at 0, and the flag F3 is set at 0. Thereafter, the operation returns to step N-1.

With respect to the discharge of the document in the operating sequence mentioned above, the following fact should be worthy of attention. Firstly, when a document to be discharged is relatively large and therefore, receives a relatively large discharge resistance in the state partly discharged into the document receiving means 30 from the document delivery passage 254, the delivering portion driving means 272 is continued to be energized over a relatively long period of time from the time when the rear end of the document has passed the document detector 274, and therefore, the discharge roller pairs 268 and 270 continued to be rotated for a relatively long period of time. On the other hand, when the document to be discharged is relatively small and its resistance received in the state partly received onto the document receiving means 30 from the document delivery passage 254 is relatively small, the delivery portion driving means 272 is energized for a relatively short period of time from the time when the rear end of the document has passed the document detector 274, and therefore, the discharge roller pairs 268 and 270 are driven to rotate over a relatively short period of time. Thus, when the document is relatively small, the delivery portion driving means 272 does not continue to be energized for a long period of time more than necessary (when energization is performed, a waiting time until the next document begins to be carried becomes more than necessary). Accordingly, not only a relatively small document but also a relatively large document can be discharged onto the document receiving means 30 fully well as required.

Secondly, when a document already discharged does not exist on the document receiving means 30, the document discharged partly onto the document receiving means 30 from the document delivery passage 254 moves on the surface, and therefore, the document receives a relatively large moving resistance. On the other hand, when an already discharged document exists on the document receiving means 30, the document partly discharged onto the document receiving means 30 from the document delivery passage 254 moves on the surface of the previous document, and the document receives a relatively small moving resistance. In view of this fact, in the above-mentioned automatic document conveying apparatus 2, the discharge speed V3-1 of the first document is set at somewhat larger than the discharge speed of the second or subsequent document. Thus, the first document like the second or subsequent document can be fully well discharged at a required position on the document receiving means 30.

Although not described in the flow chart of FIGS. 10 to 14, in the illustrated automatic document conveying apparatus 2, when the document is clogged in any of the document carrying passage 108, the document transfer passage 252 and the document delivering passage 254, the clogging of the document is detected, for example, (1) the document detector 82 does not detect the document even when a predetermined period of time elapses from the energization of the carrying clutch 66; (2) the document detector 90 does not detect the document even when a predetermined period of time elapses from the energization of the delivering clutch 80; (3) the document detector 82 continues to detect the document even when a predetermined period of time elapses from the detection of the document by the document detector 82; (4) the document detector 274 does not detect the document even when a predetermined period of time elapses from the energization of the transfer portion driving means 250; or (5) the document detector 274 continues to detect the document even when a predetermined period of time elapses from the detection of the document by the document detector 274. When the clogging of the document is detected, and when the document detector 145 disposed in the upstream end portion of the document carrying passage 108 detects the document, the electromagnetic solenoid 184 constituting a state changing means is energized. Thus, the restriction member 152 is isolated from the feed roller 72, and the separation roller 202 can be freely rotated. Hence, the document existing in the upstream portion of the document carrying passage 108 can be fully easily taken out without breakage or damage. When the document detector 145 cannot detect the document by taking out the document, the electromagnetic solenoid 184 is de-energized.

In the automatic document conveying apparatus constructed in accordance with the first aspect of the invention, when a single document conveying state is selected in place of a continuous document conveying state, it is possible to fully reliably avoid breakage or damage of a document having a high importance such as an origin of a design.

In the automatic document conveying apparatus constructed in accordance with the second aspect of the invention, irrespective of a number of documents placed in a stacked state on the document placing means 18, the action of the carrying roller on the documents to be carried is maintained almost constant, and the documents can be carried fully stably.

In the automatic document conveying apparatus constructed in accordance with the third aspect of the invention, when the front portion of the document is curved upwardly or the document has a relatively low stiffness and is large in size, the document can be well conveyed fully well by the action of a synthetic resin guide member.

In the automatic document conveying apparatus constructed in accordance with the fourth aspect of the invention, when the document is relatively small, the energization time of the delivery portion driving means cannot be lengthened more than necessary, and when the document is either relatively small or relatively large, the document can be fully well discharged.

In the automatic document conveying apparatus constructed in accordance with the fifth aspect of the invention, the first document and the second or subsequent document can be discharged onto the document conveying means in nearly the same way, and thus all discharged documents can be fully well stacked.

What we claim is:

1. An automatic document conveying apparatus comprising document placing means, means defining a document carrying passage extending from the document placing means, document sending means for sending a document placed on the document placing means to the document carrying passage, and document overlappingly sending preventing means disposed downstream of the document sending means for preventing two or more documents from being conveyed simultaneously through the document carrying passage, the document overlappingly sending preventing means, including a feed roller and a separation roller disposed in opposition to each other, between which a document is sent by the action of the document sending means, first means for rotating the feed roller in a document conveying direction, second means for rotating the separation roller in a direction opposite to the document conveying directions, means for detachably connecting the separation roller to the second rotating means, state changing means disposed in relation to the separation roller for selectively determining a continuous document conveying state in which the separation roller is connected to the second rotating means and driven to rotate in a direction opposite to the document conveying direction and a single document conveying state in which the separation roller is liberated from the second rotating means and is allowed to be freely rotated in the document conveying direction.

2. The automatic document conveying apparatus of claim 1 further comprising manual input means for controlling the action of the state changing means.

3. The automatic document conveying apparatus of claim 1 further comprising a transmission shaft and a transmission gear interposed between the separation roller and the second rotating means and mounted rotatably and movably in an axial direction between a connecting position, in which the transmission shaft is connected to the transmission gear in the continuous document conveying state, and a separation position, in which the transmission shaft and the transmission gear are separated in the single document conveying state.

4. The automatic document conveying apparatus of claim 3 further comprising elastic biasing means disposed to elastically bias the transmission shaft at the separation position, and wherein the state changing means comprises an electromagnetic solenoid for moving the transmission shaft to the connecting position against the elastic biasing action of the elastic biasing means.

5. The automatic document conveying apparatus of claim 4 further comprising a torque limiter for restricting the transmission torque in the direction opposite to the document conveying direction to a predetermined value, said torque limiter being interposed between the separation roller and the transmission shaft.

6. The automatic document conveying apparatus of claim 1 wherein the document overlappingly sending preventing means further includes a restriction member mounted movably on an upstream side of the separation roller for movement between an acting position at which the restriction member approaches or contacts the feed roller and a non-acting position at which the restriction member is isolated from the feed roller, and wherein the state changing means positions the restriction member at the acting position in the continuous document conveying state and positions the restriction member at the non-acting position in the single document conveying state.

7. The automatic document conveying apparatus of claim 1 further comprising means responsive to the operation of the document conveying being stopped while a document exists in the document overlappingly sending preventing means for causing the state changing means to determine the single document conveying state.

8. The automatic document conveying apparatus of claim 1 further comprising means cooperating with a transparent plate on an image processing machine to define a document transfer passage following the document carrying passage and along the transparent plate of the image processing machine; means defining a document delivery passage extending from the document transfer passage to document receiving means; means responsive to the state changing means determining the continuous document conveying state for conveying a document at a first conveying speed V1 through at least the document carrying passage and the document transfer passage, and responsive to the state changing means determining the single document conveying state for conveying the document at a second conveying speed V2, smaller than the first conveying speed V1, through at least the document carrying passage and the document transfer passage.

9. The automatic document conveying apparatus of claim 8 wherein $0.6 \times V1 < V2 < 0.8 \times V1$.

10. The automatic document conveying apparatus of claim 8 further comprising means responsive to the rear end of the document passing a predetermined position in the document delivery passage for conveying the document at a discharge speed V3 smaller than the first conveying speed V1 and the second conveying speed V2.

11. An automatic document conveying apparatus comprising document placing means, means defining a document carrying passage extending from the document placing means, document sending means for sending a document placed on the document placing means to the document carrying passage, document overlappingly sending preventing means disposed downstream of the document sending means for preventing two or more documents from being conveyed simultaneously through the document carrying passage; the document overlappingly sending preventing means including a feed roller, means for rotating the feed roller in a document conveying direction, a restriction member, means movably mounting the restriction member in relation to the feed roller for movement between an acting position at which the restriction member approaches or contacts the feed roller and a non-acting position at which the restriction member is isolated from the feed roller, and state changing means disposed in relation to the restriction member for selectively determining a continuous document conveying state in which the restriction member is positioned at the acting position and a single document conveying state in which the restriction member is positioned at the non-acting position.

12. The automatic document conveying apparatus of claim 11 further comprising manual input means for controlling the action of the state changing means.

13. The automatic document conveying apparatus of claim 11 wherein the state changing means comprises an electromagnetic solenoid.

14. The automatic document conveying apparatus of claim 11 further comprising means responsive to the operation of the document conveying being stopped while a document exists in the document overlappingly sending preventing means for causing the state changing means to determine the single document conveying state.

15. The automatic document conveying apparatus of claim 11 further comprising means cooperating with a transparent plate on an image processing machine to define a document transfer passage following the document carrying passage and along the transparent plate of the image processing machine; means defining a document delivery passage extending from the document transfer passage to document receiving means; means responsive to the state changing means determining the continuous document conveying state for conveying a document at a first conveying speed V1 through at least the document carrying passage and the document transfer passage, and responsive to the state changing means determining the single document conveying state for conveying the document at a second conveying speed V2, smaller than the first conveying speed V1, through at least the document carrying passage and the document transfer passage.

16. The automatic document conveying apparatus of claim 15 wherein $0.6 \times V1 < V2 < 0.8 \times V1$.

17. The automatic-document conveying apparatus of claim 16 further comprising means responsive to the rear end of the document passing a predetermined position in the document delivery passage for conveying the document at a discharge speed V3 smaller than the first conveying speed V1 and the second conveying speed V2.

18. An automatic document conveying apparatus comprising document placing means, means defining a document carrying passage extending from the document placing means, document sending means for sending a document placed on the document placing means to the document carrying passage, the document sending means including a carrying roller formed of a relatively soft material and means for driving the carrying roller to rotate in a document carrying direction, a pressing member formed of a relatively rigid material and disposed in opposition to the carrying roller, biasing means for biasing the pressing member toward the peripheral surface of the carrying roller such that the front end portion of a document placed on the document placing means is interposed between the carrying roller and the pressing member, and collar members formed of a relatively rigid material and concentrically and rotatably mounted on both sides of the carrying roller, the outer diameter of the collar members being substantially the same as, or somewhat smaller than, the outer diameter of the carrying roller, and both end portions of the pressing member being positioned in opposition to the collar members.

19. The automatic document conveying apparatus of claim 18 wherein the collar members are formed of a synthetic resin and the carrying roller is formed of a rubber.

20. The automatic document conveying apparatus of claim 18 wherein the biasing means comprises an electromagnetic solenoid, and means for energizing the electromagnetic solenoid to bias the pressing member against the peripheral surfaces of the carrying roller and the collar members, the pressing member being isolated from the carrying roller and the collar members when the electromagnetic solenoid is de-energized.

21. The automatic document conveying apparatus of claim 18 wherein the pressing member is disposed above the carrying roller; and further comprising document overlappingly sending preventing means disposed downstream of the document sending means for preventing two or more documents from being conveyed simultaneously through the document carrying passage, the overlappingly sending preventing means including:

a lower side feed roller and an upper side separation roller disposed in opposition to each other, between which a document is sent by the action of the document sending means, means for driving the feed roller to rotate in a document conveying direction, means for driving the separation roller to rotate in a direction opposite to the document conveying direction, and a guide member formed of a synthetic resin film, disposed on both sides of the carrying roller, the collar members, the pressing member, the feed roller and the separation roller, and extending from the upstream side of the carrying roller toward the feed roller and the separation roller and from above the carrying roller to below the nip site between the feed roller and the separation roller.

22. The automatic document conveying apparatus of claim 21 wherein the document overlappingly sending preventing means further includes a restriction member approaching or contacting the feed roller on the upstream side of the separation roller, and wherein the guiding member extends below the forward end of the restriction member.

23. An automatic document conveying apparatus comprising document placing means, means defining a document carrying passage extending from the document placing means, document sending means for sending a document placed on the document placing means to the document carrying passage, document overlappingly sending preventing means disposed downstream of the document sending means for preventing two or more document from being conveyed simultaneously through the document carrying passage, the document sending means including a carrying roller formed of a relatively soft material and means for driving the carrying roller to rotate in a document carrying direction, a pressing member formed of a relatively rigid material and disposed opposite to the carrying roller, biasing means for biasing the pressing member toward the peripheral surface of the carrying roller such that the front portion of a document placed on the document placing means is interposed between the carrying roller and the pressing member, the document overlappingly sending preventing means including:

a lower side feed roller and an upper side separation roller disposed opposite to each other, between which a document is sent by the action of the document sending means, means for driving the feed roller to rotate in a document conveying direction, and means for driving the separation roller to rotate in a direction opposite to the document conveying direction;

said automatic document conveying apparatus further comprising a guide member formed of a synthetic resin film, disposed on both sides of the carrying roller, the pressing member, the feed roller and the separation roller, and extending from the upstream side of the carrying roller toward the feed roller and the separation roller and from above the carrying roller to below the nip site of the feed roller and the separation roller.

24. The automatic document conveying apparatus of claim 23 wherein the document overlappingly sending preventing means further includes a restriction members approaching or contacting the feed roller upstream of the separation roller, and wherein the guide member extends below the forward end of the restriction member.

25. An automatic document conveying apparatus comprising document placing means, document receiving means; means defining a document conveying passage including a document carrying passage extending from the document placing means, a document transfer passage following the document carrying passage and adapted to extend along a transparent plate of an image processing machine, and a document delivery passage extending from the document transfer passage to the document receiving means; document conveying means including document carrying means for conveying a document through the document carrying passage, document transfer means for transferring a document through the document transfer passage, and document delivering means for delivering a document through the document delivery passage; carried document detecting means for detecting a document carried through the document carrying passage; delivered document detecting means for detecting a document delivered through the document delivery passage; operation control means normally causing the document delivering means to deliver the document at a delivery speed V1, and responsive to the delivered document detecting means detecting the rear end of the document for decreasing the document delivery speed by the document delivering means to a discharge speed V3 smaller than the delivery speed V1, responsive to the passage of a predetermined period of time T for stopping the operation of the document delivering means, responsive to the document detected by the carried document detecting means being larger than a first predetermined size for adjusting the predetermined period of time to be T-L, and responsive to the document detected by the carried document detecting means being smaller than a second predetermined size for adjusting the predetermined period of time to be T-S, where the predetermined period of time T-L is longer than the predetermined period of time T-S.

26. The automatic document conveying apparatus of claim 25 wherein the predetermined period of time T-L is longer than the predetermined period of time T-S by 70 to 130 msec.

27. The automatic document conveying apparatus of claim 25 wherein the operation control means is responsive to the document detected by the delivered document detecting means from the beginning of the operation being the first document, for adjusting the discharge speed to be V3-1, and is responsive to the document detected by the delivered document detecting means from the beginning of the operation being the second or a subsequent document, for adjusting the discharge speed to be V3-2, where the discharge speed V3-1 is larger than the discharge speed V3-2.

28. The automatic document conveying apparatus of claim 25 wherein $0.3\times V1 \leqq V3-1 \leqq 0.4\times V1$ and $0.2\times V1 \leqq V3-2 \leqq 0.3\times V1$.

29. An automatic document conveying apparatus comprising document placing means, document receiving means, means defining a document conveying passage including a document carrying passage extending from the document placing means, a document transfer passage following the document carrying passage and adapted to extend along a transparent plate of an image processing machine, and a document delivery passage extending from the document transfer passage to the document receiving means; document conveying means including document carrying means for conveying a document through the document carrying passage, document transfer means for transferring the document through the document transfer passage, and document delivering means for delivering the document through the document passage; carried document detecting means for detecting a document carried through the document carrying passage; delivered document detecting means for detecting a document delivered through the document delivery passage; operation control means normally causing the document delivery means to deliver the document at a delivering speed V1, and responsive to the delivered document detecting means detecting the rear end of the document for decreasing the delivering speed by the document delivering means to a delivering speed V3 smaller than the delivering speed V1, responsive to the lapse of a predetermined period of time T for stopping the operation of the document delivery means, responsive to the document detected by the delivered document detecting means from the beginning of the operation being the first document, for adjusting the discharge speed to be V3-1, and responsive to the document detected by the delivered document detecting means from the beginning of the operation being the second or a subsequent document, for adjusting the discharge speed to be V3-2, where the discharge speed V3-1 is larger than the discharge speed V3-2.

30. The automatic document conveying apparatus of claim 29 wherein $0.3\times V1 \leqq V3-1 \leqq 0.4\times V1$ and $0.2\times V1 \leqq V3-2 \leqq 0.3\times V1$.

31. The automatic document conveying apparatus comprising document placing means; document receiving means; means defining a document conveying passage including a document carrying passage extending from the document placing means, a document transfer passage following the document carrying passage and adapted to extend along a transparent plate of an image processing machine, and a document delivery passage extending from the document transfer passage to the document receiving means; document conveying means including document carrying means for conveying a document through the document carrying passage, document transfer means for conveying the document through the document transfer passage, and document delivering means for discharging the document through the document delivery passage; state changing means for selectively determining a continuous document conveying state or a single document conveying state; and control means responsive to the state changing means determining the continuous document conveying state for causing the document carrying means and the document transfer means to convey the document at a conveying speed V1 at least through the document carrying passage and the document transfer passage, and responsive to the state changing means determining the single document conveying state for causing the document carrying means and the document transfer means to convey the document through at least the document carrying passage and the document transfer passage at a conveying speed V2 than the conveying speed V1.

32. The automatic document conveying apparatus of claim 31 wherein $0.6\times V1 < V2 < 0.8\times V1$.

33. The automatic document conveying apparatus of claim 31 or 32 further comprising manual input means for controlling the operation of the state changing means.

* * * * *